US008679597B2

(12) United States Patent
Nito et al.

(10) Patent No.: US 8,679,597 B2
(45) Date of Patent: Mar. 25, 2014

(54) RECORDING MEDIUM

(71) Applicant: Canon Kabushiki Kaisha, Tokyo (JP)

(72) Inventors: Yasuhiro Nito, Yokohama (JP); Hisao Kamo, Ushiku (JP); Tetsuro Noguchi, Hachioji (JP); Ryo Taguri, Sagamihara (JP); Isamu Oguri, Yokohama (JP); Olivia Herlambang, Kawasaki (JP); Naoya Hatta, Kawasaki (JP); Shinya Yumoto, Kawasaki (JP); Kazuhiko Araki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/678,331

(22) Filed: Nov. 15, 2012

(65) Prior Publication Data

US 2013/0129943 A1 May 23, 2013

(30) Foreign Application Priority Data

Nov. 21, 2011 (JP) ..... 2011-253959

(51) Int. Cl.
*B41M 5/00* (2006.01)
*B41M 5/50* (2006.01)
*B41M 5/52* (2006.01)

(52) U.S. Cl.
CPC ..... *B41M 5/508* (2013.01); *B41M 5/52* (2013.01); *B41M 5/5218* (2013.01); *B41M 5/506* (2013.01); *B41M 5/5254* (2013.01)
USPC ..... 428/32.18; 428/32.24; 428/32.25; 428/32.26; 428/32.28; 428/32.34

(58) Field of Classification Search
CPC ..... B41M 5/508; B41M 5/52; B41M 5/5218; B41M 5/506; B41M 5/5254
USPC ..... 428/32.18, 32.24, 32.25, 32.26, 32.28, 428/32.34
See application file for complete search history.

(56) References Cited

U.S. PATENT DOCUMENTS

| | | | | |
|---|---|---|---|---|
| 6,387,473 | B1 * | 5/2002 | Sismondi et al. | 428/32.34 |
| 2001/0004487 | A1 * | 6/2001 | Kaneko et al. | 428/195 |
| 2003/0011155 | A1 * | 1/2003 | Hsia | 280/47.38 |
| 2003/0049420 | A1 * | 3/2003 | Inoue et al. | 428/195 |
| 2003/0072925 | A1 * | 4/2003 | Kiyama et al. | 428/195 |
| 2003/0081103 | A1 * | 5/2003 | Ishimaru et al. | 347/105 |
| 2008/0241436 | A1 | 10/2008 | Kobayashi | |
| 2011/0256324 | A1 | 10/2011 | Noguchi | |
| 2012/0207949 | A1 * | 8/2012 | Noguchi et al. | 428/32.25 |

FOREIGN PATENT DOCUMENTS

JP 2004-001528 A 1/2004

* cited by examiner

*Primary Examiner* — Betelhem Shewareged
(74) *Attorney, Agent, or Firm* — Canon U.S.A., Inc. IP Division

(57) ABSTRACT

A recording medium includes, in sequence, a support, a first ink-receiving layer, and a second ink-receiving layer, in which a content of a boric acid in the first ink-receiving layer is 2.0% by mass or more and 7.0% by mass or less with respect to a content of a polyvinyl alcohol in the first ink-receiving layer, a content of a boric acid in the second ink-receiving layer is 10.0% by mass or more and 30.0% by mass or less with respect to a content of a polyvinyl alcohol in the second ink-receiving layer, an outermost surface layer of the recording medium has a content of particles of 0.5% by mass or more and 5.0% by mass or less, the particles having an average secondary particle size of 1.0 μm or more and 20.0 μm or less with respect to a content of an inorganic pigment.

8 Claims, No Drawings

RECORDING MEDIUM

BACKGROUND OF THE INVENTION

1. Field of the Invention

The present invention relates to a recording medium.

2. Description of the Related Art

Known examples of recording media in which recording is performed with ink include recording media each including an ink-receiving layer on a support. Recent trends toward higher recording speed have required recording media having higher ink absorbency.

Japanese Patent Laid-Open No. 2004-1528 discloses a recording medium including a plurality of ink-receiving layers on a support. In the recording medium, the mass ratio of a content of the binder to a content of the pigment (binder-to-pigment ratio) of each of the ink-receiving layers is increased with increasing distance from the ink-receiving layer remote from the support toward the ink-receiving layer adjacent to the support, thereby improving the ink absorbency and the adhesion between the support and the ink-receiving layers.

SUMMARY OF THE INVENTION

For a recording medium on which an image is recorded, a disadvantageous "cracking phenomenon by folding" is known. The cracking phenomenon by folding is a phenomenon in which the image is cracked along a crease when the recording medium on which the image is recorded is folded. In recent years, the cracking phenomenon by folding has been attracting particular attention as a technical issue in the field of photo books, photo albums, and so forth, which have been increasingly demanded. A mechanism for the occurrence of cracking by folding in a process for producing a photo book or a photo album is described below.

A photo book or a photo album is produced by a method described below. An image is recorded on one surface of a first recording medium. A crease is made in the recording medium along the center line of the recording medium. In this case, a left-side surface is referred to as a left surface, and a right-side surface is referred to as a right surface, with respect to the crease. Next, a second recording medium is prepared. As with the first recording medium, an image is recorded, and a crease is made. The back surface of the right surface of the first recording medium is bonded to the back surface of the left surface of the second recording medium. A plurality of recording media are subjected to the same operation, thereby producing a photo book or a photo album that may use a double-page spread centered on the crease of each of the recording media. In this production process, when an image extending from one page to a subsequent page is recorded on a recording medium, it has been found that cracking of the image by folding occurs. Thus, a recording medium used for photo books and photo albums is required to have high resistance to cracking by folding.

In addition, properties required for a recording medium used for photo books and photo albums include high optical density of an image to be formed, suppressed occurrence of cracking after the coating of an ink-receiving layer, high ink absorbency, high gloss, and high ease of turning by hand.

It was found from studies by the inventors that the recording medium disclosed in Japanese Patent Laid-Open No. 2004-1528 does not have sufficient resistance to cracking by folding or sufficient ease of turning by hand.

Accordingly, aspects of the present invention can provide a recording medium configured to achieve high optical density of an image to be formed, inhibit the occurrence of cracking after the coating of an ink-receiving layer, and have high ink absorbency, high resistance to cracking by folding, high gloss, and high ease of turning by hand.

According to one aspect of the present invention, a recording medium includes, in sequence, a support, a first ink-receiving layer, and a second ink-receiving layer, in which the first ink-receiving layer contains at least one inorganic pigment selected from the group consisting of an alumina, an alumina hydrate, and a fumed silica, a polyvinyl alcohol, and a boric acid, and the second ink-receiving layer contains at least one inorganic pigment selected from the group consisting of an alumina and an alumina hydrate, a polyvinyl alcohol, and a boric acid, in which a content of the boric acid in the first ink-receiving layer is 2.0% by mass or more and 7.0% by mass or less with respect to a content of the polyvinyl alcohol in the first ink-receiving layer, and a content of the boric acid in the second ink-receiving layer is 10.0% by mass or more and 30.0% by mass or less with respect to a content of the polyvinyl alcohol in the second ink-receiving layer, in which an outermost surface layer of the recording medium contains particles having an average secondary particle size of 1.0 μm or more and 20.0 μm or less, in which a content of the particles having an average secondary particle size of 1.0 μm or more and 20.0 μm or less is 0.5% by mass or more and 5.0% by mass or less with respect to a content of the inorganic pigment in the outermost surface layer.

Further features of the present invention will become apparent from the following description of exemplary embodiments.

DESCRIPTION OF THE EMBODIMENTS

The circumstances that led to the present invention will be described. A traditional ink-receiving layer formed of a single ink-receiving layer containing an inorganic pigment, a polyvinyl alcohol, and a cross-linking agent, such as a boric acid, often contains a relatively large amount of the cross-linking agent. Thus, such an ink-receiving layer often has a high degree of cross-linking. In this case, cracking that occurs after the coating of the ink-receiving layer is likely to be effectively inhibited, thereby providing an ink-receiving layer having satisfactory ink absorbency. However, the resulting ink-receiving layer is brittle because of its high degree of cross-linking, so that the ink-receiving layer sometimes has low resistance to cracking by folding.

In the case where no cross-linking agent is contained, cracking occurring after coating is pronounced to reduce the ink absorbency. In addition, the ink-receiving layer sometimes has a low resistance to cracking by folding. The reason for this is not clear but is probably that in the case where the polyvinyl alcohol is not cross-linked, bonds among the polyvinyl alcohol, the inorganic pigment, and water resistant support are weakened.

The inventors have conducted intensive studies and have found that when the polyvinyl alcohol in the ink-receiving layer is cross-linked in a specific range, satisfactory resistance to cracking by folding is provided. In the specific range, however, cracking after coating occurs, and the ink absorbency is reduced, in some cases. Accordingly, the inventors have found that in the case where two ink-receiving layers, i.e., a first ink-receiving layer and a second ink-receiving layer, are provided and where the degree of cross-linking of the polyvinyl alcohol in each of the two layers is specified, the cracking resistance after coating, ink absorbency, and resistance to cracking by folding can be increased.

The inventors have conducted further studies and have found that the addition of particles each having a specific particle size to the outermost surface of a recording medium increase the gloss and the ease of turning by hand without impairing the resistance to cracking after the coating of the ink-receiving layers and the resistance to cracking by folding. The inventors also have found that the present of the particles increases the ink absorbency.

Recording Medium

A recording medium according to aspects of the present invention will be described in detail below. The recording medium according to aspects of the present invention includes a support and at least two ink-receiving layers, i.e., a first ink-receiving layer and a second ink-receiving layer. The first ink-receiving layer and the second ink-receiving layer are provided in that order on the support. That is, the first ink-receiving layer is closer to the support than the second ink-receiving layer. Furthermore, the outermost surface layer of the recording medium according to aspects of the present invention contains particles.

According to aspects of the present invention, in the case where the recording medium includes the two ink-receiving layers of the first ink-receiving layer and the second ink-receiving layer, the second ink-receiving layer serves as the outermost surface layer. That is, in the recording medium having the structure, the second ink-receiving layer contains the particles. In the case where the recording medium includes three ink-receiving layers and where a third ink-receiving layer is provided so as to be remoter from the support than the second ink-receiving layer, the third ink-receiving layer serves as the outermost surface layer and contains the particles. In aspects of the present invention, the first ink-receiving layer may be adjacent to the second ink-receiving layer.

In aspects of the present invention, the recording medium may include the support, the first ink-receiving layer, and the second ink-receiving layer provided in that order, the second ink-receiving layer containing the particles. Alternatively, the recording medium may include the support, the first ink-receiving layer, the second ink-receiving layer, and the outermost surface layer provided in that order, the outermost surface layer containing the particles.

Support

In aspects of the present invention, a water resistant support may be used as the support. Examples of the water resistant support include supports (resin-coated paper) each obtained by covering a base paper with a resin; synthetic paper; and plastic films. In particular, resin-coated paper may be used as the water resistant support.

An example of the base paper that may be used for the resin-coated paper is plain paper commonly used. Smooth base paper used as a photographic support may be used. In particular, base paper which has been subjected to surface treatment in which compression is performed under pressure with, for example, a calender during papermaking or after papermaking and which has high surface smoothness may be used. Examples of a pulp constituting base paper include natural pulp, recycled pulp, and synthetic pulp. These pulps may be used separately or in combination as a mixture of two or more. The base paper may contain additives, such as a sizing agent, a paper-strengthening agent, a filler, an antistatic agent, a fluorescent whitener, and a dye, which are commonly used in papermaking. Furthermore, the base paper may be coated with a surface-sizing agent, a surface-strengthening agent, a fluorescent whitener, an antistatic agent, a dye, and an anchoring agent. The base paper preferably has a density of 0.6 g/cm$^3$ or more and 1.2 g/cm$^3$ or less and more preferably 0.7 g/cm$^3$ or more. A density of 1.2 g/cm$^3$ or less results in the inhibition of reductions in cushioning properties and transport properties. A density of 0.6 g/cm$^3$ or more results in the inhibition of a reduction in surface smoothness. The base paper may have a thickness of 50.0 μm or more. A thickness of 50.0 μm or more results in improvements in tensile strength, tear strength, and texture. The base paper may have a thickness of 350.0 μm or less in view of productivity and so forth. The thickness of the resin (resin layer) with which the base paper is coated is preferably 5.0 μm or more and more preferably 8.0 μm or more, and preferably 40.0 μm or less and more preferably 35.0 μm or less. A thickness of 5.0 μm or more results in the inhibition of the penetration of water and gas into the base paper and the inhibition of cracking of the ink-receiving layers by folding. A thickness of 40.0 μm or less results in improvement in anticurl properties. Examples of the resin that may be used include low-density polyethylene (LDPE) and high-density polyethylene (HDPE). In addition, linear low-density polyethylene (LLDPE) and polypropylene may be used. In particular, for a resin layer located on the side (surface side) where the ink-receiving layers are formed, a rutile or anatase titanium oxide, a fluorescent whitener, or ultramarine blue may be added to polyethylene to improve opacity, brightness, and hues. In the case where the resin layer contains a titanium oxide, a content of the titanium oxide is preferably 3.0% by mass or more and more preferably 4.0% by mass or more, and preferably 20.0% by mass or less and more preferably 13.0% by mass or less with respect to the total mass of the resin.

Examples of the plastic film include films formed of thermoplastic resins, such as polyethylene, polypropylene, polystyrene, polyvinyl chloride, and polyester; and thermosetting resins, such as urea resins, melamine resins, and phenolic resins. The plastic film may have a thickness of 50.0 μm or more and 250.0 μm or less.

The water resistant support may have a desired surface state, for example, a glossy surface, a semi-glossy surface, or a matt surface. In particular, the semi-glossy surface or the matt surface may be used. For example, when a resin is melt-extruded onto a surface of base paper to perform coating, embossing may be performed by bringing the surface of the resin into pressure contact with a roller having a patterned surface with irregularities to form the semi-glossy surface or the matt surface. In the case where the ink-receiving layers are formed on the support having the semi-glossy surface or the matt surface, irregularities reflecting the irregularities of the support are formed on a surface of the ink-receiving layer, i.e., on a surface of the recording medium. This inhibits glare due to excessively high gloss. The bonding area between the support and the ink-receiving layer is large, thus improving resistance to cracking by folding. The arithmetical mean roughness (Ra), complying with JIS B0601:2001, of the surface of the recording medium at a cutoff length of 0.8 mm is preferably 0.3 μm or more and 6.0 μm or less and more preferably 0.5 μm or more and 3.0 μm or less. An arithmetical mean roughness of 0.3 μm or more and 6.0 μm or less results in satisfactory gloss.

In aspects of the present invention, a primer layer mainly composed of a hydrophilic polymer, e.g., a gelatin or polyvinyl alcohol, may be formed on the surface of the support where the ink-receiving layers are formed. Alternatively, adhesion-improving treatment, e.g., corona discharge or plasma treatment, may be performed. Thus, the adhesion between the support and the ink-receiving layer may be improved.

Materials that may be used for the ink-receiving layers according to aspects of the present invention will be described in detail below.

Ink-Receiving Layer

The first and second ink-receiving layers according to aspects of the present invention may be solidified layers of coating liquids configured to form the ink-receiving layers (hereinafter, referred to as "ink-receiving layer coating liquids"), the solidified layers being formed by applying the ink-receiving layer coating liquids to the water resistant support and drying the resulting coating film. The entire thickness of the ink-receiving layers including the first ink-receiving layer and the second ink-receiving layer is preferably 15.0 μm or more and more preferably 20.0 μm or more, and preferably 50.0 μm or less and more preferably 40.0 μm or less. When the entire thickness of the ink-receiving layers is 15.0 μm or more and 50.0 μm or less, it is possible to achieve a satisfactory optical density, ink absorbency, and resistance to cracking by folding. In particular, the entire thickness of the ink-receiving layers may be 30.0 μm or more and 38.0 μm or less.

The first ink-receiving layer contains at least one inorganic pigment selected from the group consisting of an alumina, an alumina hydrate, and a fumed silica; a polyvinyl alcohol; and a boric acid. The second ink-receiving layer contains at least one inorganic pigment selected from the group consisting of an alumina and an alumina hydrate; a polyvinyl alcohol; and a boric acid. These components will be described below.

Alumina

Examples of the alumina include a γ-alumina, an α-alumina, a δ-alumina, a θ-alumina, and a χ-alumina. Among these compounds, the γ-alumina may be used from the viewpoint of achieving a good optical density and ink absorbency. An example of the γ-alumina is a commercially available fumed γ-alumina (e.g., trade name: AEROXIDE Alu C, manufactured by EVONIK Industries).

Alumina Hydrate

The alumina hydrate represented by general formula (X) may be used:

$$Al_2O_{3-n}(OH)_{2n}.mH_2O \quad (X)$$

wherein n represents 0, 1, 2, or 3, and m represents a value of 0 or more and 10 or less and preferably 0 or more and 5 or less, with the proviso that m and n are not zero at the same time, m may represent an integer value or not an integer value because $mH_2O$ often represents detachable water that does not participate in the formation of a crystal lattice, and m may reach zero when the alumina hydrate is heated.

Known crystal structures of the alumina hydrate include amorphous, gibbsite, and boehmite, depending on heat-treatment temperature. An alumina hydrate having any of these crystal structures may be used. In particular, an alumina hydrate having a boehmite structure or an amorphous structure determined by X-ray diffraction analysis may be used. Specific examples of the alumina hydrate include alumina hydrates described in, for example, Japanese Patent Laid-Open Nos. 7-232473, 8-132731, 9-66664, and 9-76628. Specific examples of the shape of the alumina hydrate used in aspects of the present invention include indefinite shapes; and definite shapes, such as spherical and plate-like shapes. Any of the indefinite shapes and the definite shapes may be used. Alternatively, they may be used in combination. In particular, an alumina hydrate whose primary particles have a number-average particle size of 5 nm or more and 50 nm or less may be used. A plate-like alumina hydrate having an aspect ratio of 2 or more may be used. The aspect ratio may be determined by a method described in Japanese Patent Publication No. 5-16015. That is, the aspect ratio is expressed as the ratio of the diameter to the thickness of a particle. The term "diameter" used here indicates the diameter (circle-equivalent diameter) of a circle having an area equal to the projected area of each alumina hydrate particle when the alumina hydrate is observed with a microscope or an electron microscope.

In aspects of the present invention, the specific surface area of the alumina hydrate determined by the Brunauer-Emmett-Teller (BET) method, i.e., BET specific surface area, is preferably 100 $m^2/g$ or more and 200 $m^2/g$ or less and more preferably 125 $m^2/g$ or more and 190 $m^2/g$ or less. The BET method employed here indicates a method in which molecules or ions each having a known size are allowed to adsorb on surfaces of a sample and the specific surface area of the sample is determined from the amount of the molecules or ions adsorbed. In aspects of the present invention, nitrogen gas is used as a gas to be adsorbed on the sample.

The alumina hydrate may be produced by a known method, for example, a method in which an aluminum alkoxide is hydrolyzed or a method in which sodium aluminate is hydrolyzed, as described in U.S. Pat. Nos. 4,242,271 and 4,202,870. Alternatively, the alumina hydrate may also be produced by a known method, for example, a method in which an aqueous solution of sodium aluminate is neutralized by the addition of an aqueous solution of aluminum sulfate, aluminum chloride, or the like. Specific examples of the alumina hydrate used in aspects of the present invention include alumina hydrates having a boehmite structure and amorphous structure, which are determined by X-ray diffraction analysis. A specific example of the alumina hydrate is a commercially available alumina hydrate (for example, trade name: DISPERAL HP14, manufactured by Sasol).

The alumina and the alumina hydrate may be used in combination as a mixture. In the case where the alumina and the alumina hydrate are mixed together, a powdery alumina and a powdery alumina hydrate may be mixed and dispersed to prepare a dispersion (sol). Alternatively, an alumina dispersion and an alumina hydrate dispersion may be mixed together. Each of the alumina and the alumina hydrate in the dispersion preferably has an average particle size (secondary particle size) of 50 nm or more and 300 nm or less and more preferably 100 nm or more and 200 nm or less. The average particle size (secondary particle size) of each of the alumina and the alumina hydrate in the dispersion may be measured by a dynamic light scattering method. Specifically, a dispersion like a dilute aqueous solution prepared by diluting the dispersion with deionized water may be measured with a measuring device (ELSZ series, e.g., ELSZ-1 or ELSZ-2, manufactured by Otsuka Electronics Co., Ltd.), thereby measuring the average particle size of the alumina and the alumina hydrate.

Fumed Silica

The fumed silica indicates a silica produced by the combustion of silicon tetrachloride, hydrogen, and oxygen, and is also referred to as dry process silica. An example of the fumed silica is a commercially available fumed silica (e.g., trade name: AEROSIL 300, manufactured by EVONIK industries).

The fumed silica preferably has a BET specific surface area of 50 $m^2/g$ or more and more preferably 200 $m^2/g$ or more, and preferably 400 $m^2/g$ or less and more preferably 350 $m^2/g$ or less from the viewpoint of achieving good ink absorbency, optical density, and resistance to cracking during coating and drying. The BET specific surface area is determined in the same way as the alumina hydrate described above. The fumed silica in the ink-receiving layer coating liquid (dispersion) containing the fumed silica preferably has an average particle size (secondary particle size) of 50 nm or more and 300 nm or less and more preferably 100 nm or more and 200 nm or less. The average particle size of the fumed silica in the dispersion may be measured by the same method as that for measuring the average particle size of the alumina and the alumina hydrate described above.

Polyvinyl Alcohol

An example of the polyvinyl alcohol is a common polyvinyl alcohol produced by hydrolysis of a polyvinyl acetate. The polyvinyl alcohol preferably has a viscosity-average polymerization degree of 2000 or more and 4500 or less and more preferably 3000 or more and 4000 or less. A viscosity-average polymerization degree of 2000 or more and 4500 or less results in improvements in ink absorbency, optical density, and resistance to cracking by folding, and results in the inhibition of occurrence of cracking during coating. The polyvinyl alcohol may be a partially or completely saponified polyvinyl alcohol. The polyvinyl alcohol may have a saponification degree of 85% by mole or more and 100% by mole or less. An example of the polyvinyl alcohol is PVA 235 (manufactured by Kuraray Co., Ltd., saponification degree: 88% by mole, average degree of polymerization: 3500).

In the case where the polyvinyl alcohol is incorporated into the ink-receiving layer coating liquid, the polyvinyl alcohol may be contained in an aqueous solution. A polyvinyl alcohol-containing aqueous solution may have a polyvinyl alcohol concentration of 4.0% by mass or more and 15.0% by mass or less in terms of solid content. A polyvinyl alcohol concentration of 4.0% by mass or more and 15.0% by mass results in the inhibition of a significant reduction in drying rate due to an excessive reduction in the concentration of the coating liquid, and results in the inhibition of a decrease in smoothness due to a significant increase in the viscosity of the coating liquid caused by an increase in the concentration of the coating liquid.

Each of the ink-receiving layers may contain a binder other than the polyvinyl alcohol, as needed. To sufficiently provide advantageous effects of aspects of the present invention, a content of the binder other than the polyvinyl alcohol may be 50.0% by mass or less with respect to the total mass of the polyvinyl alcohol.

Boric Acid

Examples of the boric acid include orthoboric acid ($H_3BO_3$), metaboric acid, and hypoboric acid. These compounds may be used in the form of borates. Examples of the borates include orthoborates, such as $InBO_3$, $ScBO_3$, $YBO_3$, $LaBO_3$, $Mg_3(BO_3)_2$, and $Co_3(BO_3)_2$); diborates, such as $Mg_2B_2O_5$ and $Co_2B_2O_5$; metaborates, such as $LiBO_2$, $Ca(BO_2)_2$, $NaBO_2$, and $KBO_2$); tetraborates, such as $Na_2B_4O_7.10H_2O$; pentaborates, such as $KB_5O_8.4H_2O$, $Ca_2B_6O_{11}.7H_2O$, and $CsB_5O_5$; and hydrates thereof. Among these borates, orthoboric acid may be used in view of the temporal stability of the coating liquid. In aspects of the present invention, a content of the orthoboric acid is preferably 80% by mass or more and 100% by mass or less and more preferably 90% by mass or more and 100% by mass or less with respect to the total mass of the boric acid.

In the case where the boric acid is incorporated into the ink-receiving layer coating liquid, the boric acid may be contained in an aqueous solution. A boric acid-containing aqueous solution may have a solid content of 0.5% by mass or more and 8.0% by mass or less. A boric acid concentration of 0.5% by mass or more and 8.0% by mass or less results in the inhibition of a significant reduction in drying rate due to a reduction in the concentration of the coating liquid, and results in the inhibition of the precipitation of the boric acid.

Additive

Each of the ink-receiving layers of the recording medium according to aspects of the present invention may contain an additive, as needed. Examples of the additive include fixing agents, such as cationic resins; flocculants, such as multivalent metal salts; surfactants; fluorescent whiteners; thickeners; antifoaming agents; foam inhibitors; release agents; penetrants; lubricants; ultraviolet absorbers; antioxidants; leveling agents; preservatives; and pH regulators.

Characteristic structures of the first ink-receiving layer, the second ink-receiving layer, and the outermost surface layer will be described in detail below.

First Ink-Receiving Layer

In aspects of the present invention, a content of the boric acid in the first ink-receiving layer is 2.0% by mass or more and 7.0% by mass or less with respect to a content of the polyvinyl alcohol in the first ink-receiving layer. A content of the boric acid of 2.0% by mass or more and 7.0% by mass or less results in the inhibition of the occurrence of cracking after coating and an increase in resistance to cracking by folding. The content of the boric acid in the first ink-receiving layer may be 3.0% by mass or more and 6.5% by mass or less with respect to the content of the polyvinyl alcohol in the first ink-receiving layer.

The first ink-receiving layer contains, as the inorganic pigment, at least one compound selected from an alumina, an alumina hydrate, and a fumed silica. The alumina hydrate has a high surface density of hydroxy groups and high bonding strength to the polyvinyl alcohol, compared with the fumed silica and the alumina. Thus, the inorganic pigment in the first ink-receiving layer preferably has a content of the alumina hydrate of 50.0% by mass or more, more preferably 80% by mass or more, and particularly preferably 100% by mass, i.e., the inorganic pigment consists of the alumina hydrate, in view of the resistance to cracking by folding.

The content of the polyvinyl alcohol in the first ink-receiving layer is preferably 11.0% by mass or more and 40.0% by mass or less and more preferably 12.0% by mass or more and 30.0% by mass or less with respect to a content of the inorganic pigment in the first ink-receiving layer. A content of the polyvinyl alcohol of 11.0% by mass or more and 40.0% by mass or less further improves the inhibition of cracking after coating, the ink absorbency, and the resistance to cracking by folding. The first ink-receiving layer preferably has a thickness of 20.0 μm or more and 40.0 μm or less, more preferably 25.0 μm or more and 35.0 μm or less, and particularly preferably 26.5 μm or more and 33.0 μm or less.

Second Ink-Receiving Layer

In aspects of the present invention, a ratio of the amount of the boric acid to the amount of the polyvinyl alcohol in the second ink-receiving layer is higher than that in the first ink-receiving layer. In aspects of the present invention, the ratio in the second ink-receiving layer is not simply higher than that in the first ink-receiving layer. The content of the boric acid in the second ink-receiving layer is 10.0% by mass or more and 30.0% by mass or less with respect to the content of the polyvinyl alcohol in the second ink-receiving layer. The second ink-receiving layer with a content of the boric acid of 10.0% by mass or more and 30.0% by mass or less has an appropriately high degree of cross-linking of the polyvinyl alcohol, compared with the first ink-receiving layer. Thus, even if ink droplets land, the polyvinyl alcohol is less likely to swell, thereby providing high ink absorbency and improving the resistance to cracking during coating and drying. The content of the boric acid in the second ink-receiving layer may be 12.0% by mass or more and 25.0% by mass or less with respect to the content of the polyvinyl alcohol in the second ink-receiving layer.

The content of the polyvinyl alcohol in the second ink-receiving layer is preferably 5.0% by mass or more and 10.0% by mass or less and more preferably 6.0% by mass or more and 9.0% by mass or less with respect to a content of the inorganic pigment in the second ink-receiving layer. A content of the polyvinyl alcohol of 5.0% by mass or more and 10.0% by mass or less results in the inhibition of the occurrence of cracking after coating and the enhancement of ink absorbency and resistance to cracking by folding, in combination with the structure of the first ink-receiving layer having the amount of the boric acid with respect to the amount of the polyvinyl alcohol.

The second ink-receiving layer contains, as the inorganic pigment, at least one compound selected from the alumina and the alumina hydrate. The total mass of the alumina and the alumina hydrate is preferably 90% by mass or more and more preferably 100% by mass, i.e., the inorganic pigment in the second ink-receiving layer consists of the alumina and/or the alumina hydrate, with respect to the total mass of the inorganic pigment in the second ink-receiving layer. The second ink-receiving layer may contain, as the inorganic pigment, both of the alumina and the alumina hydrate. In the case where the second ink-receiving layer contains, as the inorganic pigment, both of the alumina and the alumina hydrate, the ratio of the alumina to alumina hydrate may be 60:40 to 80:20.

The second ink-receiving layer preferably has a thickness of 5.0 μm or more and 20.0 μm or less and more preferably 7.0 μm or more and 15.0 μm or less. A thickness ratio of the second ink-receiving layer to the first ink-receiving layer, i.e., second ink-receiving layer/first ink-receiving layer, may be 0.08 or more and 1.0 or less. A thickness ratio of 0.08 or more and 1.0 or less results in satisfactory resistance to cracking by folding, ink absorbency, and resistance to cracking during coating and drying.

In aspects of the present invention, a thin film may be provided between the first ink-receiving layer and the support or between the first ink-receiving layer and the second ink-receiving layer as long as advantageous effects of aspects of the present invention are not significantly impaired. The thin film may have a thickness of 0.1 μm or more and 3.0 μm or less.

The term "thickness" used in aspects of the present invention indicates a thickness in a dry state, the thickness being defined as the average value of measurement values obtained by measuring the thicknesses at four points in a section with a scanning electron microscope. In aspects of the present invention, an object whose thickness is measured is set to a quadrangle. The four points are located at positions 1 cm from the four corners toward the center of gravity of the quadrangle.

Outermost Surface Layer

The outermost surface layer of the recording medium according to aspects of the present invention contains particles having an average secondary particle size of 1.0 μm or more and 20.0 μm or less. The inventors have conducted studies and have found that the presence of the particles on the outermost surface of the recording medium imparts appropriate sliding properties to the recording medium, thereby improving the ease of turning by hand when a photo book is produced. A photo book produced with double-sided gloss paper having the layer structure of the recording medium according to aspects of the present invention on each surface thereof effectively inhibits the occurrence of phenomena, such as bonding of ink-receiving layers and sticking of the ink-receiving layers by friction, which are liable to occur, in particular, when side-stitched or perfect-bound photo books without boards are used. Thereby, a user can view the photo book without stress.

As the particles, organic particles and inorganic particles may be used. The particles preferably have an average secondary particle size of 2.0 μm or more and 10.0 μm or less and more preferably 2.0 μm or more and 6.0 μm or less. A content of the particles is 0.5% by mass or more and 5.0% by mass or less with respect to a content of the inorganic pigment in the outermost surface layer. When the content of the particles is within the range described above, the ease of turning by hand is improved without impairing the gloss. The content of the particles may be 1.5% by mass or more and 4.0% by mass or less. The average secondary particle size of the particles according to aspects of the present invention is defined by observing a surface of the recording medium with an optical microscope, measuring diameters of 100 freely selected particles, and calculating the average value of the diameters.

Examples of the organic particles that may be used include, but are not particularly limited to, particles composed of organic substances, such as polyamide resins, polyester resins, polycarbonate resins, polyolefin resins, polysulfone resins, polystyrene resins, polyvinyl chloride resins, polyvinylidene chloride resins, polyphenylene sulfide resins, ionomer resins, acrylic-based resins, vinyl-based resins, urea resins, melamine resins, urethane resins, nylon, copolymer compounds of these resins, cellulose-based compounds, and starch. Among these compounds, polyolefin resins, polystyrene resins, acrylic-based resins, and starch may be used. In particular, polyolefin resins may be used. The shape of the organic particles is not particularly limited. It is speculated that the shape may be closer to a globular shape. In particular, the shape may be a spherical shape. The surface charge of the particles may be cationic or nonionic in view of affinity because the alumina used for the ink-receiving layers is cationic. In particular, the surface charge of the particles may be cationic.

As the inorganic particles, a wet-process silica may be used. As the wet-process silica, precipitated silica or gel silica may be used. The precipitated silica can be produced by the reaction of sodium silicate and sulfuric acid under alkaline conditions. Specifically, the precipitated silica is produced through the following steps: After silica particles are grown, the particles are aggregated and precipitated. The particles are filtered, washed with water, dried, pulverized, and classified. Secondary particles of the silica produced by this method are relatively easily pulverized. Examples of the precipitated silica include commercially available products, such as NIPSIL (manufactured by Tosoh Silica Corporation) and TOKUSIL and FINESIL (manufactured by Tokuyama Corporation). Specific examples of the precipitated silica include NIPSIL K-500 (manufactured by Tosoh Silica Corporation), FINESIL X-37 (manufactured by Tokuyama Corporation), FINESIL X-37B (manufactured by Tokuyama Corporation), and FINESIL X-45 (manufactured by Tokuyama Corporation).

The gel silica can be produced by the reaction of sodium silicate and sulfuric acid under acidic conditions. The employment of the production process results in the aggregation of silica particles while the growth of primary particles is inhibited, thereby providing aggregated particles in which the primary particles are strongly bonded together. Examples of the gel silica include commercially available products, such as MIZUKASIL (manufactured by Mizusawa Industrial Chemicals, Ltd.) and SYLOJET (manufactured by Grace Japan K.K). Specific examples of the gel silica include MIZUKASIL P-707 (manufactured by Mizusawa Industrial Chemicals, Ltd.) and MIZUKASIL P78A (manufactured by Mizusawa Industrial Chemicals, Ltd).

The surface charge of the wet-process silica is typically anionic. The anionic wet-process silica has a high affinity to the alumina and thus may be used as it is. Alternatively, the wet-process silica may be cationized with a cationic polymer or the like before use.

In aspects of the present invention, in the case where the second ink-receiving layer serves as the outermost surface layer of the recording medium, the second ink-receiving layer contains the particles. In the case where the outermost surface layer of the recording medium according to aspects of the present invention is different from the second ink-receiving layer and where is separately provided, the outermost surface layer contains the particles. In this case, the second ink-receiving layer may also contain the particles. According to the studies by the inventors, however, the presence of the particles on the outermost surface layer of the recording medium is very important for improvement in the ease of turning by hand. Thus, in the case of a recording medium including the second ink-receiving layer and the outermost surface layer, the particles in the second ink-receiving layer contributes less significantly to the effect. Accordingly, a content of the particles in the second ink-receiving layer is preferably 0.1% by mass or less, more preferably 0.01% by mass or less, and particularly preferably 0.00% by mass with respect to the inorganic pigment in the second ink-receiving layer.

In the case where the recording medium includes the outermost surface layer different from the second ink-receiving layer, the outermost surface layer may contain an inorganic pigment, a polyvinyl alcohol, and a boric acid in addition to the particles having an average secondary particle size of 1.0 μm or more and 20.0 μm or less.

In the case where the outermost surface layer contains the polyvinyl alcohol and the boric acid, a content of the boric acid in the outermost surface layer is preferably 10.0% by mass or more and 30.0% by mass or less and more preferably 12.0% by mass or more and 25.0% by mass or less with respect to the polyvinyl alcohol.

A content of the polyvinyl alcohol in the outermost surface layer is preferably 5.0% by mass or more and 10.0% by mass or less and more preferably 6.0% by mass or more and 9.0% by mass or less with respect to the inorganic pigment in the outermost surface layer.

The outermost surface layer may contain, as the inorganic pigment, at least one compound selected from an alumina and an alumina hydrate. The total mass of the alumina and the alumina hydrate is preferably 90% by mass or more and more preferably 100% by mass with respect to the total mass of the inorganic pigment in the outermost surface layer. The outermost surface layer may contain, as the inorganic pigment, both of the alumina and the alumina hydrate. In the case where the outermost surface layer contains, as the inorganic pigment, both of the alumina and the alumina hydrate, the ratio of the alumina to the alumina hydrate may be 60:40 to 80:20.

In the case where the outermost surface layer is provided separately from the second ink-receiving layer, the outermost surface layer preferably has a thickness of 0.10 μm or more and 5.0 μm or less and more preferably 0.2 μm or more and 3.0 μm or less.

Ink-Receiving Layer Coating Liquid

Sol Containing at Least One Compound Selected from Alumina and Alumina Hydrate

According to aspects of the present invention, the alumina or the alumina hydrate in the form of a dispersion in a deflocculated state due to a deflocculant may be added to the ink-receiving layer coating liquid. A dispersion containing the alumina hydrate deflocculated with the deflocculant is also referred to as an alumina hydrate sol. A dispersion containing the alumina deflocculated with the deflocculant is also referred to as an alumina sol. A sol containing at least one compound selected from the alumina and the alumina hydrate may further contain an acid serving as a deflocculant. In addition, the sol may further contain an additive, for example, a dispersion medium, a pigment dispersant, a thickener, a flow improver, an antifoaming agent, a foam inhibitor, a surfactant, a release agent, a penetrant, a color pigment, a color dye, a fluorescent whitener, an ultraviolet absorber, an antioxidant, a preservative, a fungicide, a water resistant additive, a dye fixing agent, a cross-linking agent, or a weatherproofer. Examples of the dispersion medium used for the sol containing at least one compound selected from the alumina and the alumina hydrate include water, organic solvents, and mixed solvent thereof. In particular, water may be used. In aspects of the present invention, an acid (deflocculating acid) may be used as a deflocculant.

In aspects of the present invention, the alumina hydrate dispersion may contain, as a deflocculating acid, an alkylsulfonic acid having 1 to 4 carbon atoms. That is, the ink-receiving layers may contain the alkylsulfonic acid having 1 to 4 carbon atoms.

The use of an alkylsulfonic acid having 4 or less carbon atoms or a sulfonic acid including a benzene ring as the deflocculant improves the color stability and the moisture resistance and easily increases the optical density. The reason for this is believed that a smaller number of carbon atoms reduce the hydrophobicity of the deflocculant to reduce the hydrophobicity of surfaces of the alumina hydrate particles, thereby increasing the dye fixing speed on the surfaces of the alumina hydrate particles. In the case where the alumina hydrate is deflocculated with the alkylsulfonic acid having 4 or less carbon atoms or the sulfonic acid including a benzene ring, particularly satisfactory dispersion stability can be provided, thereby inhibiting an increase in the viscosity of the dispersion. Furthermore, the aggregation of the alumina hydrate can be inhibited, thereby improving the optical density.

The alkylsulfonic acid having 1 to 4 carbon atoms may be a monobasic acid containing only a sulfo group as a solubilizing group. An alkyl group that does not have a solubilizing group, e.g., a hydroxy group or carboxy group, may be used in view of moisture resistance. The alkylsulfonic acid may be a monobasic acid, and the alkyl group may be an unsubstituted alkyl group having 1 to 4 carbon atoms. The alkyl group may be linear or branched. Examples of the alkylsulfonic acid that may be used include methanesulfonic acid, ethanesulfonic acid, isopropanesulfonic acid, n-propanesulfonic acid, n-butanesulfonic acid, isobutanesulfonic acid, and tert-butanesulfonic acid. Among these compounds, methanesulfonic acid, ethanesulfonic acid, isopropanesulfonic acid, and n-propanesulfonic acid may be used. In particular, methanesulfonic acid may be used. Two or more types of alkylsulfonic acids each having 1 to 4 carbon atoms may be used in combination.

A content of the alkylsulfonic acid may be 1.0% by mass or more and 2.0% by mass or less with respect to the alumina hydrate. A content of the alkylsulfonic acid of less than 1.0% by mass results in unsatisfactory resistance to moisture and ozone. A content of the alkylsulfonic acid of more than 2.0% by mass results in unsatisfactory ink absorbency. The content of the alkylsulfonic acid may be 1.3% by mass or more. The content of the alkylsulfonic acid may be 1.6% by mass or less.

Sol Containing Fumed Silica

The fumed silica used in aspects of the present invention may be added to the ink-receiving layer coating liquid in a state in which the silica is dispersed in a dispersion medium.

A dispersion containing a cation polymer serving as a mordant and the fumed silica dispersed therein is defined as a fumed silica sol. Examples of the cationic polymer include polyethyleneimine resins, polyamine resins, polyamide resins, polyamide-epichlorohydrin resins, polyamine-epichlorohydrin resins, polyamide-polyamine-epichlorohydrin resins, polydiallylamine resins, and dicyandiamide condensates. These cationic resins may be used separately or in combination. The fumed silica sol may contain a multivalent metal salt. Examples of the multivalent metal salt include aluminum compounds, such as poly(aluminum chloride), poly(aluminum acetate), and poly(aluminum lactate). The fumed silica sol may further contain an additive, for example, a surface modifier, such as a silane coupling agent, a thickener, a flow improver, an antifoaming agent, a foam inhibitor, a surfactant, a release agent, a penetrant, a color pigment, a color dye, a fluorescent whitener, an ultraviolet absorber, an antioxidant, a preservative, a fungicide, a water resistant additive, a cross-linking agent, or a weatherproofer. Examples of the dispersion medium for the fumed silica sol include water, organic solvents, and mixed solvents thereof. In particular, water may be used.

Method for Applying Ink-Receiving Layer Coating Liquid

In aspects of the present invention, the ink-receiving layer coating liquid is applied and dried to form an ink-receiving layer. The ink-receiving layer coating liquid may be applied by a known coating method. Examples of the coating method include a slot die method, a slide bead method, a curtain method, an extrusion method, an air-knife method, a roll coating method, and a rod-bar coating method. The coating liquid for the first ink-receiving layer and the coating liquid for the second ink-receiving layer may be applied and dried by a sequential coater or may be applied by simultaneous multilayer coating. In particular, simultaneous multilayer coating may be performed by the slide bead method because of its high productivity.

Drying after coating may be performed by a hot-air dryer, e.g., a linear tunnel dryer, an arch dryer, an air-loop dryer, or a sine-curve air float dryer, or a dryer using infrared rays, heating, microwaves, or the like.

EXAMPLES

While aspects of the present invention will be specifically described below by examples, aspects of the present invention are not limited to these examples. Note that the term "part(s)" indicates part(s) by mass.

Production of Water Resistant Support

A pulp containing 80 parts of laubholz bleached kraft pulp (LBKP) having a freeness of 450 mL in terms of Canadian Standard Freeness (CSF) and 20 parts of nadelholz bleached kraft pulp (NBKP) having a freeness of 480 mL in terms of CSF was prepared. Next, 0.60 parts of cationized starch, 10 parts of heavy calcium carbonate, 15 parts of precipitated calcium carbonate, 0.10 parts of alkyl ketene dimer, and 0.03 parts of cationic polyacrylamide were added to the pulp. The mixture was adjusted with water so as to have a solid content of 3.0% by mass, thereby preparing a paper material. The resulting paper material was subjected to paper making with a Fourdrinier machine, in which three-stage wet pressing was performed, followed by drying with a multi-cylinder dryer. The resulting paper was impregnated with an aqueous solution of oxidized starch so as to have a solid content of 1.0 g/m$^2$ with a size press, and then dried. The dry paper was subjected to machine calendering to provide a base paper having a basis weight of 155 g/m$^2$.

A resin composition containing low-density polyethylene (70 parts), high-density polyethylene (20 parts), and titanium oxide (10 parts) was applied to each surface of the base paper in such a manner that the resulting resin layers each had a thickness of 25.0 μm, thereby forming the resin layers. Immediately after the formation of the resin layers, gloss treatment was performed using a cooling roll having a mirror-finished surface to allow each resin layer to have a glossy surface. Each resin layer was subjected to corona discharge. Then acid-treated gelatin was applied in a coating weight of 0.05 g/m$^2$ in terms of solid content, thereby forming adhesion-improving layers. Thereby, the water resistant support for double-sided gloss paper was produced.

Preparation of Alumina Hydrate Sol

First, 1.5 parts of methanesulfonic acid serving as a deflocculant was added to 333 parts of deionized water to prepare an aqueous solution of methanesulfonic acid. Then 100 parts of an alumina hydrate (DISPERAL HP14, manufactured by Sasol) was gradually added to the aqueous solution of methanesulfonic acid under stirring at 3000 rpm with a homomixer (T.K. Homomixer MARK II Model 2.5, manufactured by Tokushu Kika Kogyo Co., Ltd). After the completion of the addition, the mixture was stirred for 30 minutes to prepare an alumina hydrate sol having a solid content of 23.0% by mass. The average secondary particle size of the alumina hydrate in the alumina hydrate sol was measured with ELSZ-2 (manufactured by Otsuka Electronics Co., Ltd.) and found to be 160 nm.

Preparation of Alumina Sol

First, 1.5 parts of methanesulfonic acid serving as a deflocculant was added to 333 parts of deionized water to prepare an aqueous solution of methanesulfonic acid. Then 100 parts of an alumina (AEROXIDE Alu C, manufactured by EVONIK Industries) was gradually added to the aqueous solution of methanesulfonic acid under stirring at 3000 rpm with a homomixer (T.K. Homomixer MARK II Model 2.5, manufactured by Tokushu Kika Kogyo Co., Ltd). After the completion of the addition, the mixture was stirred for 30 minutes to prepare an alumina sol having a solid content of 23.0% by mass. The average secondary particle size of the alumina in the alumina sol was measured with ELSZ-2 (manufactured by Otsuka Electronics Co., Ltd.) and found to be 180 nm.

Preparation of Fumed Silica Sol

First, 4.0 parts of a cationic polymer (Shallot DC-902P, manufactured by Dai-Ichi Kogyo Seiyaku Co., Ltd) was added to 333 parts of deionized water to prepare an aqueous solution of the cationic polymer. Then 100 parts of a fumed silica (AEROSIL 300, manufactured by EVONIK Industries) was gradually added to the aqueous solution of the cationic polymer under stirring at 3000 rpm with a homomixer (T.K. Homomixer MARK II Model 2.5, manufactured by Tokushu Kika Kogyo Co., Ltd). After the completion of the addition, the mixture was diluted with deionized water and was homogenized twice with a high-pressure homogenizer (Nanomizer, manufactured by Yoshida Kikai Co., Ltd.) to prepare a fumed silica sol having a solid content of 20.0% by mass. The average secondary particle size of the fumed silica in the fumed silica sol was measured with ELSZ-2 (manufactured by Otsuka Electronics Co., Ltd.) and found to be 150 nm.

Preparation of Polyvinyl Alcohol-Containing Aqueous Solution

First, 100 parts of polyvinyl alcohol (PVA 235, manufactured by Kuraray Co., Ltd., saponification degree: 88% by mole, average degree of polymerization: 3500) was added to 1150 parts of deionized water under stirring. After the completion of the addition, the polyvinyl alcohol was dissolved by heating to 90° C. to prepare a polyvinyl alcohol-containing aqueous solution (hereinafter, also referred to as an "aqueous polyvinyl alcohol solution) having a solid content of 8.0% by mass.

Production of Recording Medium 1

Second Ink-Receiving Layer Coating Liquid 1

The alumina hydrate sol and the alumina sol were mixed together in such a manner that the mass ratio of the alumina hydrate to the alumina in terms of solid content was 70:30, thereby forming a mixed sol. A wet-process silica (FINESIL X-37B, average secondary particle size: 3.7 μm, manufactured by Tokuyama Corporation) was mixed with the mixed sol in such a manner that the proportion of the wet-process silica in terms of solid content was 2.0 parts with respect to 100 parts of the total solid content of the alumina hydrate and the alumina in the mixed sol. The aqueous polyvinyl alcohol solution was mixed with the resulting mixed sol in such a manner that the proportion of the polyvinyl alcohol in terms of solid content was 7.0 parts, thereby forming a liquid mixture. An aqueous orthoboric acid solution having a solid content of 5.0% by mass was mixed with the liquid mixture in such a manner that the proportion of the orthoboric acid in terms of solid content was 16.4 parts with respect to 100 parts of the solid content of the polyvinyl alcohol in the liquid mixture, thereby preparing a coating liquid. A surfactant (trade name: Surfynol 465, manufactured by Nissin Chemical Industry Co., Ltd.) was mixed with the resulting coating liquid in such a manner that the proportion of the surfactant was 0.1% by mass with respect to the total mass of the coating liquid, thereby preparing a second ink-receiving layer coating liquid 1.

First Ink-Receiving Layer Coating Liquid 1

The aqueous polyvinyl alcohol solution was added to the alumina hydrate sol in such a manner that the proportion of the polyvinyl alcohol in terms of solid content was 13.0 parts with respect to 100 parts of the solid content of the alumina hydrate, thereby preparing a liquid mixture. An aqueous orthoboric acid solution having a solid content of 5.0% by mass was added to the liquid mixture in such a manner that the proportion of the orthoboric acid in terms of solid content was 5.8 parts with respect to 100 parts of the solid content of the polyvinyl alcohol in the liquid mixture, thereby preparing a first ink-receiving layer coating liquid 1.

Formation of Ink-Receiving Layer

The second ink-receiving layer coating liquid 1 and the first ink-receiving layer coating liquid 1 were applied to each surface of the support. The application was performed with a multilayer slide hopper coater in such a manner that in a dry state, the first ink-receiving layer had a thickness of 25.0 μm, the second ink-receiving layer had a thickness of 10.0 μm, and the total thickness was 35.0 μm. Subsequently, drying was performed at 60° C. to provide a recording medium 1. The resulting recording medium was a recording medium in which the support, the first ink-receiving layer, the second ink-receiving layer were arranged in that order. One hundred freely selected wet-process silica particles on the surfaces of the recording medium were measured. The average secondary particle size was calculated and found to be 3.0 μm.

Production of Recording Medium 2

A recording medium 2 was produced as in the recording medium 1, except that a first ink-receiving layer coating liquid 2 described below was used in place of the first ink-receiving layer coating liquid 1 for the recording medium 1. One hundred freely selected wet-process silica particles on the surfaces of the recording medium were measured. The average secondary particle size was calculated and found to be 3.0 μm.

First Ink-Receiving Layer Coating Liquid 2

The aqueous polyvinyl alcohol solution was added to the fumed silica sol in such a manner that the proportion of the polyvinyl alcohol in terms of solid content was 30.0 parts with respect to 100 parts of the solid content of the fumed silica, thereby preparing a liquid mixture. An aqueous orthoboric acid solution having a solid content of 5.0% by mass was added to the liquid mixture in such a manner that the proportion of the orthoboric acid in terms of solid content was 5.8 parts with respect to 100 parts of the solid content of the polyvinyl alcohol in the liquid mixture, thereby preparing a first ink-receiving layer coating liquid 2.

Production of Recording Medium 3

A recording medium 3 was produced as in the recording medium 1, except that a first ink-receiving layer coating liquid 3 described below was used in place of the first ink-receiving layer coating liquid 1 for the recording medium 1. One hundred freely selected wet-process silica particles on the surfaces of the recording medium were measured. The average secondary particle size was calculated and found to be 3.0 μm.

First Ink-Receiving Layer Coating Liquid 3

The alumina hydrate sol and the fumed silica sol were mixed together in such a manner that the ratio of the alumina hydrate to the fumed silica in terms of solid content was 25:75, thereby preparing a mixed sol. The aqueous polyvinyl alcohol solution was mixed with the mixed sol in such a manner that the proportion of the polyvinyl alcohol in terms of solid content was 25.0 parts with respect to 100 parts of the total solid content of the alumina hydrate and the fumed silica in the mixed sol, thereby preparing a liquid mixture. An aqueous orthoboric acid solution having a solid content of 5.0% by mass was mixed with the liquid mixture in such a manner that the proportion of the orthoboric acid in terms of solid content was 5.8 parts with respect to 100 parts of the solid content of the polyvinyl alcohol in the liquid mixture, thereby preparing a first ink-receiving layer coating liquid 3.

Production of Recording Medium 4

A recording medium 4 was produced as in the recording medium 1, except that a first ink-receiving layer coating liquid 4 described below was used in place of the first ink-receiving layer coating liquid 1 for the recording medium 1. One hundred freely selected wet-process silica particles on the surfaces of the recording medium were measured. The average secondary particle size was calculated and found to be 3.0 μm.

First Ink-Receiving Layer Coating Liquid 4

The alumina hydrate sol and the fumed silica sol were mixed together in such a manner that the ratio of the alumina hydrate to the fumed silica in terms of solid content was 75:25, thereby preparing a mixed sol. The aqueous polyvinyl alcohol solution was mixed with the mixed sol in such a manner that the proportion of the polyvinyl alcohol in terms of solid content was 18.0 parts with respect to 100 parts of the total solid content of the alumina hydrate and the fumed silica in the mixed sol, thereby preparing a liquid mixture. An aqueous orthoboric acid solution having a solid content of 5.0% by mass was mixed with the liquid mixture in such a manner that the proportion of the orthoboric acid in terms of solid content was 5.8 parts with respect to 100 parts of the solid content of the polyvinyl alcohol in the liquid mixture, thereby preparing a first ink-receiving layer coating liquid 4.

Production of Recording Medium 5

A recording medium 5 was produced as in the recording medium 1, except that a first ink-receiving layer coating liquid 5 described below was used in place of the first ink-receiving layer coating liquid 1 for the recording medium 1. One hundred freely selected wet-process silica particles on the surfaces of the recording medium were measured. The average secondary particle size was calculated and found to be 3.0 μm.

First Ink-Receiving Layer Coating Liquid 5

The alumina hydrate sol and the alumina sol were mixed together in such a manner that the ratio of the alumina hydrate to the alumina in terms of solid content was 75:25, thereby preparing a mixed sol. The aqueous polyvinyl alcohol solution was mixed with the mixed sol in such a manner that the proportion of the polyvinyl alcohol in terms of solid content was 13.0 parts with respect to 100 parts of the total solid content of the alumina hydrate and the alumina in the mixed sol, thereby preparing a liquid mixture. An aqueous orthoboric acid solution having a solid content of 5.0% by mass was mixed with the liquid mixture in such a manner that the proportion of the orthoboric acid in terms of solid content was 5.8 parts with respect to 100 parts of the solid content of the polyvinyl alcohol in the liquid mixture, thereby preparing a first ink-receiving layer coating liquid 5.

Production of Recording Medium 6

A recording medium 6 was produced as in the recording medium 1, except that a first ink-receiving layer coating liquid 6 described below was used in place of the first ink-receiving layer coating liquid 1 for the recording medium 1. One hundred freely selected wet-process silica particles on the surfaces of the recording medium were measured. The average secondary particle size was calculated and found to be 3.0 μm.

First Ink-Receiving Layer Coating Liquid 6

The alumina hydrate sol and the alumina sol were mixed together in such a manner that the ratio of the alumina hydrate to the alumina in terms of solid content was 25:75, thereby preparing a mixed sol. The aqueous polyvinyl alcohol solution was mixed with the mixed sol in such a manner that the proportion of the polyvinyl alcohol in terms of solid content was 13.0 parts with respect to 100 parts of the total solid content of the alumina hydrate and the alumina in the mixed sol, thereby preparing a liquid mixture. An aqueous orthoboric acid solution having a solid content of 5.0% by mass was mixed with the liquid mixture in such a manner that the proportion of the orthoboric acid in terms of solid content was 5.8 parts with respect to 100 parts of the solid content of the polyvinyl alcohol in the liquid mixture, thereby preparing a first ink-receiving layer coating liquid 6.

Production of Recording Medium 7

A recording medium 7 was produced as in the recording medium 1, except that the application was performed in such a manner that the second ink-receiving layer had a thickness of 5.0 μm, the first ink-receiving layer had a thickness of 13.0 μm, and the total thickness was 18.0 μm. One hundred freely selected wet-process silica particles on the surfaces of the recording medium were measured. The average secondary particle size was calculated and found to be 3.0 μm.

Production of Recording Medium 8

A recording medium 8 was produced as in the recording medium 1, except that the application was performed in such a manner that the second ink-receiving layer had a thickness of 6.0 μm, the first ink-receiving layer had a thickness of 14.0 μm, and the total thickness was 20.0 μm. One hundred freely selected wet-process silica particles on the surfaces of the recording medium were measured. The average secondary particle size was calculated and found to be 3.0 μm.

Production of Recording Medium 9

A recording medium 9 was produced as in the recording medium 1, except that the application was performed in such a manner that the second ink-receiving layer had a thickness of 12.0 μm, the first ink-receiving layer had a thickness of 28.0 μm, and the total thickness was 40.0 μm. One hundred freely selected wet-process silica particles on the surfaces of the recording medium were measured. The average secondary particle size was calculated and found to be 3.0 μm.

Production of Recording Medium 10

A recording medium 10 was produced as in the recording medium 1, except that the application was performed in such a manner that the second ink-receiving layer had a thickness of 13.0 μm, the first ink-receiving layer had a thickness of 30.0 μm, and the total thickness was 43.0 μm. One hundred freely selected wet-process silica particles on the surfaces of the recording medium were measured. The average secondary particle size was calculated and found to be 3.0 μm.

Production of Recording Medium 11

A recording medium 11 was produced as in the recording medium 1, except that the application was performed in such a manner that the second ink-receiving layer had a thickness of 2.5 μm, the first ink-receiving layer had a thickness of 32.5 μm, and the total thickness was 35.0 μm. One hundred freely selected wet-process silica particles on the surfaces of the recording medium were measured. The average secondary particle size was calculated and found to be 3.0 μm.

Production of Recording Medium 12

A recording medium 12 was produced as in the recording medium 1, except that the application was performed in such a manner that the second ink-receiving layer had a thickness of 5.0 μm, the first ink-receiving layer had a thickness of 30.0 μm, and the total thickness was 35.0 μm. One hundred freely selected wet-process silica particles on the surfaces of the recording medium were measured. The average secondary particle size was calculated and found to be 3.0 μm.

Production of Recording Medium 13

A recording medium 13 was produced as in the recording medium 1, except that the application was performed in such a manner that the second ink-receiving layer had a thickness of 17.5 μm, the first ink-receiving layer had a thickness of 17.5 μm, and the total thickness was 35.0 μm. One hundred freely selected wet-process silica particles on the surfaces of the recording medium were measured. The average secondary particle size was calculated and found to be 3.0 μm.

Production of Recording Medium 14

A recording medium 14 was produced as in the recording medium 1, except that the application was performed in such a manner that the second ink-receiving layer had a thickness of 20.0 μm, the first ink-receiving layer had a thickness of 15.0 μm, and the total thickness was 35.0 μm. One hundred freely selected wet-process silica particles on the surfaces of the recording medium were measured. The average secondary particle size was calculated and found to be 3.0 μm.

Production of Recording Medium 15

A recording medium 15 was produced as in the recording medium 1, except that in the preparation of the second ink-receiving layer coating liquid 1 for the recording medium 1, the aqueous orthoboric acid solution having a solid content of 5% by mass was mixed in such a manner that the proportion of the orthoboric acid in terms of solid content was 10.0 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 16

A recording medium 16 was produced as in the recording medium 1, except that in the preparation of the second ink-receiving layer coating liquid 1 for the recording medium 1, the aqueous orthoboric acid solution having a solid content of 5% by mass was mixed in such a manner that the proportion of the orthoboric acid in terms of solid content was 30.0 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 17

A recording medium 17 was produced as in the recording medium 1, except that in the preparation of the second ink-receiving layer coating liquid 1 for the recording medium 1, the aqueous polyvinyl alcohol solution having a solid content of 8% by mass was mixed in such a manner that the proportion of the polyvinyl alcohol in terms of solid content was 4.0 parts with respect to 100 parts of the total solid content of the alumina hydrate and the alumina in the mixed sol. One hundred freely selected wet-process silica particles on the surfaces of the recording medium were measured. The average secondary particle size was calculated and found to be 3.0 μm.

Production of Recording Medium 18

A recording medium 18 was produced as in the recording medium 1, except that in the preparation of the second ink-receiving layer coating liquid 1 for the recording medium 1, the aqueous polyvinyl alcohol solution having a solid content of 8% by mass was mixed in such a manner that the proportion of the polyvinyl alcohol in terms of solid content was 5.0 parts with respect to 100 parts of the total solid content of the alumina hydrate and the alumina in the mixed sol. One hundred freely selected wet-process silica particles on the surfaces of the recording medium were measured. The average secondary particle size was calculated and found to be 3.0 μm.

Production of Recording Medium 19

A recording medium 19 was produced as in the recording medium 1, except that in the preparation of the second ink-receiving layer coating liquid 1 for the recording medium 1, the aqueous polyvinyl alcohol solution having a solid content of 8% by mass was mixed in such a manner that the proportion of the polyvinyl alcohol in terms of solid content was 10.0 parts with respect to 100 parts of the total solid content of the alumina hydrate and the alumina in the mixed sol. One hundred freely selected wet-process silica particles on the surfaces of the recording medium were measured. The average secondary particle size was calculated and found to be 3.0 μm.

Production of Recording Medium 20

A recording medium 20 was produced as in the recording medium 1, except that in the preparation of the second ink-receiving layer coating liquid 1 for the recording medium 1, the aqueous polyvinyl alcohol solution having a solid content of 8% by mass was mixed in such a manner that the proportion of the polyvinyl alcohol in terms of solid content was 11.0 parts with respect to 100 parts of the total solid content of the alumina hydrate and the alumina in the mixed sol. One hundred freely selected wet-process silica particles on the surfaces of the recording medium were measured. The average secondary particle size was calculated and found to be 3.0 μm.

Production of Recording Medium 21

A recording medium 21 was produced as in the recording medium 1, except that in the preparation of the first ink-receiving layer coating liquid 1 for the recording medium 1, the aqueous orthoboric acid solution having a solid content of 5.0% by mass was mixed in such a manner that the proportion of the orthoboric acid in terms of solid content was 2.3 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 22

A recording medium 22 was produced as in the recording medium 1, except that in the preparation of the first ink-receiving layer coating liquid 1 for the recording medium 1, the aqueous orthoboric acid solution having a solid content of 5.0% by mass was mixed in such a manner that the proportion of the orthoboric acid in terms of solid content was 6.9 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 23

A recording medium 23 was produced as in the recording medium 2, except that in the preparation of the first ink-receiving layer coating liquid 2 for the recording medium 2, the aqueous orthoboric acid solution having a solid content of 5.0% by mass was mixed in such a manner that the proportion of the orthoboric acid in terms of solid content was 2.3 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 24

A recording medium 24 was produced as in the recording medium 2, except that in the preparation of the first ink-receiving layer coating liquid 2 for the recording medium 2, the aqueous orthoboric acid solution having a solid content of 5.0% by mass was mixed in such a manner that the proportion of the orthoboric acid in terms of solid content was 7.0 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 25

A recording medium 25 was produced as in the recording medium 3, except that in the preparation of the first ink-receiving layer coating liquid 3 for the recording medium 3, the aqueous orthoboric acid solution having a solid content of 5.0% by mass was mixed in such a manner that the proportion of the orthoboric acid in terms of solid content was 2.4 parts with respect to 100 parts of the solid content of the polyvinyl alcohol. One hundred freely selected wet-process silica particles on the surfaces of the recording medium were measured. The average secondary pcls Production of Recording Medium 26

A recording medium 26 was produced as in the recording medium 3, except that in the preparation of the first ink-receiving layer coating liquid 3 for the recording medium 3, the aqueous orthoboric acid solution having a solid content of 5.0% by mass was mixed in such a manner that the proportion of the orthoboric acid in terms of solid content was 6.8 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 27

A recording medium 27 was produced as in the recording medium 4, except that in the preparation of the first ink-receiving layer coating liquid 4 for the recording medium 4, the aqueous orthoboric acid solution having a solid content of 5.0% by mass was mixed in such a manner that the proportion of the orthoboric acid in terms of solid content was 2.2 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 28

A recording medium 28 was produced as in the recording medium 4, except that in the preparation of the first ink-receiving layer coating liquid 4 for the recording medium 4, the aqueous orthoboric acid solution having a solid content of 5.0% by mass was mixed in such a manner that the proportion of the orthoboric acid in terms of solid content was 6.7 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 29

A recording medium 29 was produced as in the recording medium 1, except that in the preparation of the first ink-receiving layer coating liquid 1 for the recording medium 1, the aqueous polyvinyl alcohol solution was mixed in such a manner that the proportion of the polyvinyl alcohol in terms of solid content was 10.0 parts with respect to 100 parts of the solid content of the alumina hydrate. One hundred freely selected wet-process silica particles on the surfaces of the recording medium were measured. The average secondary particle size was calculated and found to be 3.0 μm.

Production of Recording Medium 30

A recording medium 30 was produced as in the recording medium 1, except that in the preparation of the first ink-receiving layer coating liquid 1 for the recording medium 1, the aqueous polyvinyl alcohol solution was mixed in such a manner that the proportion of the polyvinyl alcohol in terms of solid content was 11.0 parts with respect to 100 parts of the solid content of the alumina hydrate. One hundred freely selected wet-process silica particles on the surfaces of the recording medium were measured. The average secondary particle size was calculated and found to be 3.0 μm.

Production of Recording Medium 31

A recording medium 31 was produced as in the recording medium 1, except that in the preparation of the first ink-receiving layer coating liquid 1 for the recording medium 1, the aqueous polyvinyl alcohol solution was mixed in such a manner that the proportion of the polyvinyl alcohol in terms of solid content was 40.0 parts with respect to 100 parts of the solid content of the alumina hydrate. One hundred freely selected wet-process silica particles on the surfaces of the recording medium were measured. The average secondary particle size was calculated and found to be 3.0 μm.

Production of Recording Medium 32

A recording medium 32 was produced as in the recording medium 1, except that in the preparation of the first ink-receiving layer coating liquid 1 for the recording medium 1, the aqueous polyvinyl alcohol solution was mixed in such a manner that the proportion of the polyvinyl alcohol in terms of solid content was 42.0 parts with respect to 100 parts of the solid content of the alumina hydrate. One hundred freely selected wet-process silica particles on the surfaces of the recording medium were measured. The average secondary particle size was calculated and found to be 3.0 μm.

Production of Recording Medium 33

A recording medium 33 was produced as in the recording medium 2, except that in the preparation of the first ink-receiving layer coating liquid 2 for the recording medium 2, the aqueous polyvinyl alcohol solution was mixed in such a manner that the proportion of the polyvinyl alcohol in terms of solid content was 10.0 parts with respect to 100 parts of the solid content of the fumed silica. One hundred freely selected wet-process silica particles on the surfaces of the recording medium were measured. The average secondary particle size was calculated and found to be 3.0 μm.

Production of Recording Medium 34

A recording medium 34 was produced as in the recording medium 2, except that in the preparation of the first ink-receiving layer coating liquid 2 for the recording medium 2, the aqueous polyvinyl alcohol solution was mixed in such a manner that the proportion of the polyvinyl alcohol in terms of solid content was 11.0 parts with respect to 100 parts of the solid content of the fumed silica. One hundred freely selected wet-process silica particles on the surfaces of the recording medium were measured. The average secondary particle size was calculated and found to be 3.0 μm.

Production of Recording Medium 35

A recording medium 35 was produced as in the recording medium 2, except that in the preparation of the first ink-receiving layer coating liquid 2 for the recording medium 2, the aqueous polyvinyl alcohol solution was mixed in such a manner that the proportion of the polyvinyl alcohol in terms of solid content was 40.0 parts with respect to 100 parts of the solid content of the fumed silica. One hundred freely selected wet-process silica particles on the surfaces of the recording medium were measured. The average secondary particle size was calculated and found to be 3.0 μm.

Production of Recording Medium 36

A recording medium 36 was produced as in the recording medium 2, except that in the preparation of the first ink-receiving layer coating liquid 2 for the recording medium 2, the aqueous polyvinyl alcohol solution was mixed in such a manner that the proportion of the polyvinyl alcohol in terms of solid content was 42.0 parts with respect to 100 parts of the solid content of the fumed silica. One hundred freely selected wet-process silica particles on the surfaces of the recording medium were measured. The average secondary particle size was calculated and found to be 3.0 μm.

Production of Recording Medium 37

A recording medium 37 was produced as in the recording medium 3, except that in the preparation of the first ink-receiving layer coating liquid 3 for the recording medium 3, the aqueous polyvinyl alcohol solution was mixed in such a manner that the proportion of the polyvinyl alcohol in terms of solid content was 10.0 parts with respect to 100 parts of the total solid content of the alumina hydrate and the fumed silica in the mixed sol. One hundred freely selected wet-process silica particles on the surfaces of the recording medium were measured. The average secondary particle size was calculated and found to be 3.0 μm.

Production of Recording Medium 38

A recording medium 38 was produced as in the recording medium 3, except that in the preparation of the first ink-receiving layer coating liquid 3 for the recording medium 3, the aqueous polyvinyl alcohol solution was mixed in such a manner that the proportion of the polyvinyl alcohol in terms of solid content was 11.0 parts with respect to 100 parts of the total solid content of the alumina hydrate and the fumed silica in the mixed sol. One hundred freely selected wet-process silica particles on the surfaces of the recording medium were measured. The average secondary particle size was calculated and found to be 3.0 μm.

Production of Recording Medium 39

A recording medium 39 was produced as in the recording medium 3, except that in the preparation of the first ink-receiving layer coating liquid 3 for the recording medium 3, the aqueous polyvinyl alcohol solution was mixed in such a manner that the proportion of the polyvinyl alcohol in terms of solid content was 40.0 parts with respect to 100 parts of the total solid content of the alumina hydrate and the fumed silica in the mixed sol. One hundred freely selected wet-process silica particles on the surfaces of the recording medium were measured. The average secondary particle size was calculated and found to be 3.0 μm.

Production of Recording Medium 40

A recording medium 40 was produced as in the recording medium 3, except that in the preparation of the first ink-receiving layer coating liquid 3 for the recording medium 3, the aqueous polyvinyl alcohol solution was mixed in such a manner that the proportion of the polyvinyl alcohol in terms of solid content was 42.0 parts with respect to 100 parts of the total solid content of the alumina hydrate and the fumed silica in the mixed sol. One hundred freely selected wet-process silica particles on the surfaces of the recording medium were measured. The average secondary particle size was calculated and found to be 3.0 μm.

Production of Recording Medium 41

A recording medium 41 was produced as in the recording medium 4, except that in the preparation of the first ink-receiving layer coating liquid 4 for the recording medium 4, the aqueous polyvinyl alcohol solution was mixed in such a manner that the proportion of the polyvinyl alcohol in terms of solid content was 10.0 parts with respect to 100 parts of the total solid content of the alumina hydrate and the fumed silica in the mixed sol. One hundred freely selected wet-process silica particles on the surfaces of the recording medium were measured. The average secondary particle size was calculated and found to be 3.0 μm.

Production of Recording Medium 42

A recording medium 42 was produced as in the recording medium 4, except that in the preparation of the first ink-receiving layer coating liquid 4 for the recording medium 4, the aqueous polyvinyl alcohol solution was mixed in such a manner that the proportion of the polyvinyl alcohol in terms of solid content was 11.0 parts with respect to 100 parts of the total solid content of the alumina hydrate and the fumed silica in the mixed sol. One hundred freely selected wet-process silica particles on the surfaces of the recording medium were measured. The average secondary particle size was calculated and found to be 3.0 μm.

Production of Recording Medium 43

A recording medium 43 was produced as in the recording medium 4, except that in the preparation of the first ink-receiving layer coating liquid 4 for the recording medium 4, the aqueous polyvinyl alcohol solution was mixed in such a manner that the proportion of the polyvinyl alcohol in terms of solid content was 40.0 parts with respect to 100 parts of the total solid content of the alumina hydrate and the fumed silica in the mixed sol. One hundred freely selected wet-process silica particles on the surfaces of the recording medium were measured. The average secondary particle size was calculated and found to be 3.0 μm.

Production of Recording Medium 44

A recording medium 44 was produced as in the recording medium 4, except that in the preparation of the first ink-receiving layer coating liquid 4 for the recording medium 4, the aqueous polyvinyl alcohol solution was mixed in such a manner that the proportion of the polyvinyl alcohol in terms of solid content was 42.0 parts with respect to 100 parts of the total solid content of the alumina hydrate and the fumed silica in the mixed sol. One hundred freely selected wet-process silica particles on the surfaces of the recording medium were measured. The average secondary particle size was calculated and found to be 3.0 μm.

Production of Recording Medium 45

A recording medium 45 was produced as in the recording medium 1, except that in the preparation of the second ink-receiving layer coating liquid 1 for the recording medium 1, the mass ratio of the alumina hydrate to the alumina in terms of solid content was 100:0. One hundred freely selected wet-process silica particles on the surfaces of the recording medium were measured. The average secondary particle size was calculated and found to be 3.0 μm.

Production of Recording Medium 46

A recording medium 46 was produced as in the recording medium 1, except that in the preparation of the second ink-receiving layer coating liquid 1 and the first ink-receiving layer coating liquid 1 for the recording medium 1, an aqueous solution (solid content: 8.0% by mass) of another polyvinyl alcohol (PVA 217, manufactured by Kuraray Co., Ltd., saponification degree: 88%, average degree of polymerization: 1700) was used in place of the aqueous polyvinyl alcohol solution. One hundred freely selected wet-process silica particles on the surfaces of the recording medium were measured. The average secondary particle size was calculated and found to be 3.0 μm.

Production of Recording Medium 47

A recording medium 47 was produced as in the recording medium 1, except that in the preparation of the second ink-receiving layer coating liquid 1 and the first ink-receiving layer coating liquid 1 for the recording medium 1, an aqueous solution (solid content: 8.0% by mass) of another polyvinyl alcohol (PVA 424, manufactured by Kuraray Co., Ltd., saponification degree: 80%, average degree of polymerization: 2400) was used in place of the aqueous polyvinyl alcohol solution. One hundred freely selected wet-process silica particles on the surfaces of the recording medium were measured. The average secondary particle size was calculated and found to be 3.0 μm.

Production of Recording Medium 48

Second Ink-Receiving Layer Coating Liquid 2

The alumina hydrate sol and the alumina sol were mixed together in such a manner that the mass ratio of the alumina hydrate to the alumina in terms of solid content was 70:30, thereby forming a mixed sol. A wet-process silica (FINESIL X-37B, average secondary particle size: 3.7 μm, manufactured by Tokuyama Corporation) was mixed with the mixed sol in such a manner that the proportion of the wet-process silica in terms of solid content was 0.5 parts with respect to 100 parts of the total solid content of the alumina hydrate and the alumina in the mixed sol. The aqueous polyvinyl alcohol solution was mixed with the resulting mixed sol in such a manner that the proportion of the polyvinyl alcohol in terms of solid content was 7.0 parts, thereby forming a liquid mixture. An aqueous orthoboric acid solution having a solid content of 5.0% by mass was mixed with the liquid mixture in such a manner that the proportion of the orthoboric acid in terms of solid content was 16.4 parts with respect to 100 parts of the solid content of the polyvinyl alcohol in the liquid mixture, thereby preparing a second ink-receiving layer coating liquid. A surfactant (trade name: Surfynol 465, manufactured by Nissin Chemical Industry Co., Ltd.) was mixed with the resulting second ink-receiving layer coating liquid in such a manner that the proportion of the surfactant was 0.1% by mass with respect to the total mass of the second ink-receiving layer coating liquid, thereby preparing a second ink-receiving layer coating liquid 2.

A recording medium 48 was produced as in the recording medium 1, except that the second ink-receiving layer coating liquid 2 was used in place of the second ink-receiving layer coating liquid 1 for the recording medium 1. One hundred freely selected wet-process silica particles on the surfaces of the recording medium were measured. The average secondary particle size was calculated and found to be 3.0 μm.

Production of Recording Medium 49

Second Ink-Receiving Layer Coating Liquid 3

The alumina hydrate sol and the alumina sol were mixed together in such a manner that the mass ratio of the alumina hydrate to the alumina in terms of solid content was 70:30, thereby forming a mixed sol. A wet-process silica (FINESIL X-37B, average secondary particle size: 3.7 μm, manufactured by Tokuyama Corporation) was mixed with the mixed sol in such a manner that the proportion of the wet-process silica in terms of solid content was 5 parts with respect to 100 parts of the total solid content of the alumina hydrate and the alumina in the mixed sol. The aqueous polyvinyl alcohol solution was added to the resulting mixed sol in such a manner that the proportion of the polyvinyl alcohol in terms of solid content was 7.0 parts, thereby forming a liquid mixture. An aqueous orthoboric acid solution having a solid content of 5.0% by mass was added to the liquid mixture in such a manner that the proportion of the orthoboric acid in terms of solid content was 16.4 parts with respect to 100 parts of the solid content of the polyvinyl alcohol in the liquid mixture, thereby preparing a second ink-receiving layer coating liquid. A surfactant (trade name: Surfynol 465, manufactured by Nissin Chemical Industry Co., Ltd.) was mixed with the resulting second ink-receiving layer coating liquid in such a manner that the proportion of the surfactant was 0.1% by mass with respect to the total mass of the second ink-receiving layer coating liquid, thereby preparing a second ink-receiving layer coating liquid 3.

A recording medium 49 was produced as in the recording medium 1, except that the second ink-receiving layer coating liquid 3 was used in place of the second ink-receiving layer coating liquid 1 for the recording medium 1. One hundred freely selected wet-process silica particles on the surfaces of the recording medium were measured. The average secondary particle size was calculated and found to be 3.0 μm.

Production of Recording Medium 50

Second Ink-Receiving Layer Coating Liquid 4

The alumina hydrate sol and the alumina sol were mixed together in such a manner that the mass ratio of the alumina hydrate to the alumina in terms of solid content was 70:30, thereby forming a mixed sol. Organic particles (cross-linked polymethyl methacrylate MBX-8, average secondary particle size: 5.0 μm, manufactured by Sekisui Plastics Co., Ltd.) were mixed with the mixed sol in such a manner that the proportion of the organic particles in terms of solid content was 5 parts with respect to 100 parts of the total solid content of the alumina hydrate and the alumina in the mixed sol. The aqueous polyvinyl alcohol solution was added to the resulting mixed sol in such a manner that the proportion of the polyvinyl alcohol in terms of solid content was 7.0 parts, thereby forming a liquid mixture. An aqueous orthoboric acid solution having a solid content of 5.0% by mass was added to the liquid mixture in such a manner that the proportion of the orthoboric acid in terms of solid content was 16.4 parts with respect to 100 parts of the solid content of the polyvinyl alcohol in the liquid mixture, thereby preparing a second ink-receiving layer coating liquid. A surfactant (trade name: Surfynol 465, manufactured by Nissin Chemical Industry Co., Ltd.) was mixed with the resulting second ink-receiving layer coating liquid in such a manner that the proportion of the surfactant was 0.1% by mass with respect to the total mass of the second ink-receiving layer coating liquid, thereby preparing a second ink-receiving layer coating liquid 4.

A recording medium 50 was produced as in the recording medium 1, except that the second ink-receiving layer coating liquid 4 was used in place of the second ink-receiving layer coating liquid 1 for the recording medium 1. One hundred freely selected wet-process silica particles on the surfaces of the recording medium were measured. The average secondary particle size was calculated and found to be 5.0 μm.

Production of Recording Medium 51

Second Ink-Receiving Layer Coating Liquid 5

The alumina hydrate sol and the alumina sol were mixed together in such a manner that the mass ratio of the alumina hydrate to the alumina in terms of solid content was 70:30, thereby forming a mixed sol. A wet-process silica (NIPGEL BY-001, average secondary particle size: 20.0 μm, manufactured by Tosoh Silica Corporation) was mixed with the mixed sol in such a manner that the proportion of the wet-process silica in terms of solid content was 2.0 parts with respect to 100 parts of the total solid content of the alumina hydrate and the alumina in the mixed sol. The aqueous polyvinyl alcohol solution was added to the resulting mixed sol in such a manner that the proportion of the polyvinyl alcohol in terms of solid content was 7.0 parts, thereby forming a liquid mixture. An aqueous orthoboric acid solution having a solid content of 5.0% by mass was added to the liquid mixture in such a manner that the proportion of the orthoboric acid in terms of solid content was 16.4 parts with respect to 100 parts of the solid content of the polyvinyl alcohol in the liquid mixture, thereby preparing a second ink-receiving layer coating liquid. A surfactant (trade name: Surfynol 465, manufactured by Nissin Chemical Industry Co., Ltd.) was mixed with the resulting second ink-receiving layer coating liquid in such a manner that the proportion of the surfactant was 0.1% by mass with respect to the total mass of the second ink-receiving layer coating liquid, thereby preparing a second ink-receiving layer coating liquid 5.

A recording medium 51 was produced as in the recording medium 1, except that in the production of the ink-receiving layers for the recording medium 1, the second ink-receiving layer coating liquid 5 was used in place of the second ink-receiving layer coating liquid 1 for the recording medium 1. One hundred freely selected wet-process silica particles on the surfaces of the recording medium were measured. The average secondary particle size was calculated and found to be 20.0 μm.

Production of Recording Medium 52

Second Ink-Receiving Layer Coating Liquid 6

The alumina hydrate sol and the alumina sol were mixed together in such a manner that the mass ratio of the alumina hydrate to the alumina in terms of solid content was 70:30, thereby forming a mixed sol. A wet-process silica (MIZUKASIL P-707A, average secondary particle size: 1.0 μm, manufactured by Mizusawa Industrial Chemicals, Ltd.) was mixed with the mixed sol in such a manner that the proportion of the wet-process silica in terms of solid content was 2.0 parts with respect to 100 parts of the total solid content of the alumina hydrate and the alumina in the mixed sol. The aqueous polyvinyl alcohol solution was added to the resulting mixed sol in such a manner that the proportion of the polyvinyl alcohol in terms of solid content was 7.0 parts, thereby forming a liquid mixture. An aqueous orthoboric acid solution having a solid content of 5.0% by mass was mixed with the liquid mixture in such a manner that the proportion of the orthoboric acid in terms of solid content was 16.4 parts with respect to 100 parts of the solid content of the polyvinyl alcohol in the liquid mixture, thereby preparing a second ink-receiving layer coating liquid. A surfactant (trade name: Surfynol 465, manufactured by Nissin Chemical Industry Co., Ltd.) was mixed with the resulting second ink-receiving layer coating liquid in such a manner that the proportion of the surfactant was 0.1% by mass with respect to the total mass of the second ink-receiving layer coating liquid, thereby preparing a second ink-receiving layer coating liquid 6.

A recording medium 52 was produced as in the recording medium 1, except that in the formation of the ink-receiving layers for the recording medium 1, the second ink-receiving layer coating liquid 6 was used in place of the second ink-receiving layer coating liquid 1 for the recording medium 1. One hundred freely selected wet-process silica particles on the surfaces of the recording medium were measured. The average secondary particle size was calculated and found to be 1.0 μm.

Production of Recording Medium 53

A recording medium 53 was produced as in the recording medium 1, except that in the formation of the ink-receiving layers for the recording medium 1, only the second ink-receiving layer having a thickness of 35.0 μm was formed as a single layer by coating. One hundred freely selected wet-process silica particles on the surfaces of the recording medium were measured. The average secondary particle size was calculated and found to be 3.0 μm.

Production of Recording Medium 54

A recording medium 54 was produced as in the recording medium 1, except that in the formation of the ink-receiving layers for the recording medium 1, only the first ink-receiving layer having a thickness of 35.0 μm was formed as a single layer by coating.

Production of Recording Medium 55

A recording medium 55 was produced as in the recording medium 2, except that in the formation of the ink-receiving layers for the recording medium 2, only the first ink-receiving layer having a thickness of 35.0 μm was formed as a single layer by coating.

Production of Recording Medium 56

A recording medium 56 was produced as in the recording medium 3, except that in the formation of the ink-receiving layers for the recording medium 3, only the first ink-receiving layer having a thickness of 35.0 μm was formed as a single layer by coating.

Production of Recording Medium 57

A recording medium 57 was produced as in the recording medium 4, except that in the formation of the ink-receiving layers for the recording medium 4, only the first ink-receiving layer having a thickness of 35.0 μm was formed as a single layer by coating.

Production of Recording Medium 58

A recording medium 58 was produced as in the recording medium 1, except that in the formation of the ink-receiving layers for the recording medium 1, the second ink-receiving layer coating liquid 1 and the first ink-receiving layer coating liquid 1 were interchanged.

Production of Recording Medium 59

A recording medium 59 was produced as in the recording medium 1, except that in the formation of the ink-receiving layers for the recording medium 1, the aqueous orthoboric acid solution was not added to the second ink-receiving layer coating liquid 1 or the first ink-receiving layer coating liquid 1. One hundred freely selected wet-process silica particles on the surfaces of the recording medium were measured. The average secondary particle size was calculated and found to be 3.0 μm.

Production of Recording Medium 60

A recording medium 60 was produced as in the recording medium 1, except that in the formation of the ink-receiving layers for the recording medium 1, the aqueous orthoboric acid solution was not added to the first ink-receiving layer coating liquid 1. One hundred freely selected wet-process silica particles on the surfaces of the recording medium were measured. The average secondary particle size was calculated and found to be 3.0 μm.

Production of Recording Medium 61

A recording medium 61 was produced as in the recording medium 1, except that in the formation of the ink-receiving layers for the recording medium 1, the aqueous orthoboric acid solution was not added to the second ink-receiving layer coating liquid 1. One hundred freely selected wet-process silica particles on the surfaces of the recording medium were measured. The average secondary particle size was calculated and found to be 3.0 μm.

Production of Recording Medium 62

A recording medium 62 was produced as in the recording medium 1, except that in the preparation of the second ink-receiving layer coating liquid 1 for the recording medium 1, the aqueous orthoboric acid solution having a solid content of 5.0% by mass was mixed in such a manner that the proportion of the orthoboric acid in terms of solid content was 35.7 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 63

A recording medium 63 was produced as in the recording medium 1, except that in the preparation of the second ink-receiving layer coating liquid 1 for the recording medium 1, the aqueous orthoboric acid solution having a solid content of 5.0% by mass was mixed in such a manner that the proportion of the orthoboric acid in terms of solid content was 9.3 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 64

A recording medium 64 was produced as in the recording medium 1, except that in the preparation of the first ink-receiving layer coating liquid 1 for the recording medium 1, the aqueous orthoboric acid solution having a solid content of 5.0% by mass was mixed in such a manner that the proportion of the orthoboric acid in terms of solid content was 1.5 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 65

A recording medium 65 was produced as in the recording medium 1, except that in the preparation of the first ink-receiving layer coating liquid 1 for the recording medium 1, the aqueous orthoboric acid solution having a solid content of 5.0% by mass was mixed in such a manner that the proportion of the orthoboric acid in terms of solid content was 7.7 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 66

A recording medium 66 was produced as in the recording medium 2, except that in the preparation of the first ink-receiving layer coating liquid 2 for the recording medium 2, the aqueous orthoboric acid solution having a solid content of 5.0% by mass was mixed in such a manner that the proportion of the orthoboric acid in terms of solid content was 1.7 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 67

A recording medium 67 was produced as in the recording medium 2, except that in the preparation of the first ink-receiving layer coating liquid 2 for the recording medium 2, the aqueous orthoboric acid solution having a solid content of 5.0% by mass was mixed in such a manner that the proportion of the orthoboric acid in terms of solid content was 7.7 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 68

A recording medium 68 was produced as in the recording medium 3, except that in the preparation of the first ink-receiving layer coating liquid 3 for the recording medium 3, the aqueous orthoboric acid solution having a solid content of 5.0% by mass was mixed in such a manner that the proportion of the orthoboric acid in terms of solid content was 1.6 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 69

A recording medium 69 was produced as in the recording medium 3, except that in the preparation of the first ink-receiving layer coating liquid 3 for the recording medium 3, the aqueous orthoboric acid solution having a solid content of 5.0% by mass was mixed in such a manner that the proportion of the orthoboric acid in terms of solid content was 7.6 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 70

A recording medium 70 was produced as in the recording medium 4, except that in the preparation of the first ink-receiving layer coating liquid 4 for the recording medium 4, the aqueous orthoboric acid solution having a solid content of 5.0% by mass was mixed in such a manner that the proportion of the orthoboric acid in terms of solid content was 1.7 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 71

A recording medium 71 was produced as in the recording medium 4, except that in the preparation of the first ink-receiving layer coating liquid 4 for the recording medium 4, the aqueous orthoboric acid solution having a solid content of 5.0% by mass was mixed in such a manner that the proportion of the orthoboric acid in terms of solid content was 7.8 parts with respect to 100 parts of the solid content of the polyvinyl alcohol. One hundred freely selected wet-process silica particles on the surfaces of the recording medium were measured. The average secondary particle size was calculated and found to be 3.0 μm.

Production of Recording Medium 72

Second Ink-Receiving Layer Coating Liquid 7

The aqueous polyvinyl alcohol solution was mixed with the alumina hydrate sol in such a manner that the proportion of the polyvinyl alcohol in terms of solid content was 6.8 parts with respect to 100 parts of the solid content of the alumina hydrate sol, thereby preparing a liquid mixture. A wet-process silica (FINESIL X-37B, average secondary particle size: 3.7 μm, manufactured by Tokuyama Corporation) was mixed with the liquid mixture in such a manner that the proportion of the wet-process silica in terms of solid content was 2.0 parts with respect to 100 parts of the total solid content of the alumina hydrate in the liquid mixture. An aqueous orthoboric acid solution having a solid content of 5.0% by mass was mixed with the liquid mixture in such a manner that the proportion of the orthoboric acid in terms of solid content was 17.7 parts with respect to 100 parts of the solid content of the polyvinyl alcohol in the liquid mixture, thereby preparing a second ink-receiving layer coating liquid. A surfactant (trade name: Surfynol 465, manufactured by Nissin Chemical Industry Co., Ltd.) was mixed with the resulting second ink-receiving layer coating liquid in such a manner that the proportion of the surfactant was 0.1% by mass with respect to the total mass of the second ink-receiving layer coating liquid, thereby preparing a second ink-receiving layer coating liquid 7.

First Ink-Receiving Layer Coating Liquid 7

The aqueous polyvinyl alcohol solution was mixed with the alumina hydrate sol in such a manner that the proportion of the polyvinyl alcohol in terms of solid content was 15.0 parts with respect to 100 parts of the solid content of the alumina hydrate, thereby preparing a liquid mixture. An aqueous orthoboric acid solution having a solid content of 5.0% by mass was mixed with the liquid mixture in such a manner that the proportion of the orthoboric acid in terms of solid content was 8.0 parts with respect to 100 parts of the solid content of the polyvinyl alcohol in the liquid mixture, thereby preparing a first ink-receiving layer coating liquid 7.

Formation of Ink-Receiving Layer

The second ink-receiving layer coating liquid 2 and the first ink-receiving layer coating liquid 7 were applied to each surface of the support with a multilayer slide hopper coater to form a total of two layers, i.e., a first ink-receiving layer and a second ink-receiving layer provided on the first ink-receiving layer in such a manner that the first ink-receiving layer had a dry thickness of 20.0 μm, the second ink-receiving layer had a dry thickness of 20.0 μm, and the total thickness was 40.0 μm. Subsequently, drying was performed at 60° C. to provide a recording medium 72. One hundred freely selected wet-process silica particles on the surfaces of the recording medium were measured. The average secondary particle size was calculated and found to be 3.0 μm.

Production of Recording Medium 73

Second Ink-Receiving Layer Coating Liquid 8

The alumina hydrate sol and the alumina sol were mixed together in such a manner that the mass ratio of the alumina hydrate to the alumina in terms of solid content was 70:30, thereby forming a mixed sol. A wet-process silica (FINESIL X-37B, average secondary particle size: 3.7 μm, manufactured by Tokuyama Corporation) was mixed with the mixed sol in such a manner that the proportion of the wet-process silica in terms of solid content was 0.3 parts with respect to 100 parts of the total solid content of the alumina hydrate and the alumina in the mixed sol. The aqueous polyvinyl alcohol solution was mixed with the resulting mixed sol in such a manner that the proportion of the polyvinyl alcohol in terms of solid content was 7.0 parts, thereby forming a liquid mixture. An aqueous orthoboric acid solution having a solid content of 5.0% by mass was mixed with the liquid mixture in such a manner that the proportion of the orthoboric acid in terms of solid content was 16.4 parts with respect to 100 parts of the solid content of the polyvinyl alcohol in the liquid mixture, thereby preparing a second ink-receiving layer coating liquid. A surfactant (trade name: Surfynol 465, manufactured by Nissin Chemical Industry Co., Ltd.) was mixed with the resulting coating liquid in such a manner that the proportion of the surfactant was 0.1% by mass with respect to the total mass of the coating liquid, thereby preparing a second ink-receiving layer coating liquid 8.

A recording medium 73 was produced as in the recording medium 1, except that the second ink-receiving layer coating liquid 8 was used in place of the second ink-receiving layer coating liquid 1 for the recording medium 1. One hundred freely selected wet-process silica particles on the surfaces of the recording medium were measured. The average secondary particle size was calculated and found to be 3.0 μm.

Production of Recording Medium 74

Second Ink-Receiving Layer Coating Liquid 9

The alumina hydrate sol and the alumina sol were mixed together in such a manner that the mass ratio of the alumina hydrate to the alumina in terms of solid content was 70:30, thereby forming a mixed sol. A wet-process silica (FINESIL X-37B, average secondary particle size: 3.7 μm, manufactured by Tokuyama Corporation) was mixed with the mixed sol in such a manner that the proportion of the wet-process silica in terms of solid content was 7.0 parts with respect to 100 parts of the total solid content of the alumina hydrate and the alumina in the mixed sol. The aqueous polyvinyl alcohol solution was added to the resulting mixed sol in such a manner that the proportion of the polyvinyl alcohol in terms of solid content was 7.0 parts, thereby forming a liquid mixture. An aqueous orthoboric acid solution having a solid content of 5.0% by mass was added to the liquid mixture in such a manner that the proportion of the orthoboric acid in terms of solid content was 16.4 parts with respect to 100 parts of the solid content of the polyvinyl alcohol in the liquid mixture, thereby preparing a second ink-receiving layer coating liquid. A surfactant (trade name: Surfynol 465, manufactured by Nissin Chemical Industry Co., Ltd.) was mixed with the resulting second ink-receiving layer coating liquid in such a manner that the proportion of the surfactant was 0.1% by mass with respect to the total mass of the second ink-receiving layer coating liquid, thereby preparing a second ink-receiving layer coating liquid 9.

A recording medium 74 was produced as in the recording medium 1, except that the second ink-receiving layer coating liquid 9 was used in place of the second ink-receiving layer coating liquid 1 for the recording medium 1. One hundred freely selected wet-process silica particles on the surfaces of the recording medium were measured. The average secondary particle size was calculated and found to be 3.0 μm.

Production of Recording Medium 75

Second Ink-Receiving Layer Coating Liquid 10

The alumina hydrate sol and the alumina sol were mixed together in such a manner that the mass ratio of the alumina hydrate to the alumina in terms of solid content was 70:30, thereby forming a mixed sol. A wet-process silica (MIZUKASIL P-707M, average secondary particle size: 35.0 μm, manufactured by Mizusawa Industrial Chemicals, Ltd.) was mixed with the mixed sol in such a manner that the proportion of the wet-process silica in terms of solid content was 2.0 parts with respect to 100 parts of the total solid content of the alumina hydrate and the alumina in the mixed sol. The aqueous polyvinyl alcohol solution was mixed with the resulting mixed sol in such a manner that the proportion of the polyvinyl alcohol in terms of solid content was 7.0 parts, thereby forming a liquid mixture. An aqueous orthoboric acid solution having a solid content of 5.0% by mass was mixed with the liquid mixture in such a manner that the proportion of the orthoboric acid in terms of solid content was 16.4 parts with respect to 100 parts of the solid content of the polyvinyl alcohol in the liquid mixture, thereby preparing a second ink-receiving layer coating liquid. A surfactant (trade name: Surfynol 465, manufactured by Nissin Chemical Industry Co., Ltd.) was mixed with the resulting second ink-receiving layer coating liquid in such a manner that the proportion of the surfactant was 0.1% by mass with respect to the total mass of the second ink-receiving layer coating liquid, thereby preparing a second ink-receiving layer coating liquid 10.

A recording medium 75 was produced as in the recording medium 1, except that the second ink-receiving layer coating liquid 10 was used in place of the second ink-receiving layer coating liquid 1 for the recording medium 1. One hundred freely selected wet-process silica particles on the surfaces of the recording medium were measured. The average secondary particle size was calculated and found to be 25.0 μm.

Production of Recording Medium 81

Second Ink-Receiving Layer Coating Liquid 11

The alumina hydrate sol and the alumina sol were mixed together in such a manner that the mass ratio of the alumina hydrate to the alumina in terms of solid content was 70:30, thereby forming a mixed sol. The aqueous polyvinyl alcohol solution was mixed with the resulting mixed sol in such a manner that the proportion of the polyvinyl alcohol in terms of solid content was 7.0 parts with respect to 100 parts of the total solid content of the alumina hydrate and the alumina in the mixed sol, thereby preparing a liquid mixture. An aqueous orthoboric acid solution having a solid content of 5.0% by mass was mixed with the liquid mixture in such a manner that the proportion of the orthoboric acid in terms of solid content was 16.4 parts with respect to 100 parts of the solid content of the polyvinyl alcohol in the liquid mixture, thereby preparing a second ink-receiving layer coating liquid. A surfactant (trade name: Surfynol 465, manufactured by Nissin Chemical Industry Co., Ltd.) was mixed with the resulting second ink-receiving layer coating liquid in such a manner that the proportion of the surfactant was 0.1% by mass with respect to the total mass of the second ink-receiving layer coating liquid, thereby preparing a second ink-receiving layer coating liquid 11.

Outermost Surface Layer Coating Liquid 1

The alumina hydrate sol and the alumina sol were mixed together in such a manner that the mass ratio of the alumina hydrate to the alumina in terms of solid content was 70:30, thereby forming a mixed sol. A wet-process silica (FINESIL X-37B, average secondary particle size: 3.7 μm, manufactured by Tokuyama Corporation) was mixed with the mixed sol in such a manner that the proportion of the wet-process silica in terms of solid content was 2.0 parts with respect to 100 parts of the total solid content of the alumina hydrate and the alumina in the mixed sol. The aqueous polyvinyl alcohol solution was added to the resulting mixed sol in such a manner that the proportion of the polyvinyl alcohol in terms of solid content was 7.0 parts, thereby forming a liquid mixture. An aqueous orthoboric acid solution having a solid content of 5.0% by mass was added to the liquid mixture in such a manner that the proportion of the orthoboric acid in terms of solid content was 16.4 parts with respect to 100 parts of the solid content of the polyvinyl alcohol in the liquid mixture, thereby preparing a second ink-receiving layer coating liquid. A surfactant (trade name: Surfynol 465, manufactured by Nissin Chemical Industry Co., Ltd.) was mixed with the resulting second ink-receiving layer coating liquid in such a manner that the proportion of the surfactant was 0.1% by mass with respect to the total mass of the second ink-receiving layer coating liquid, thereby preparing an outermost surface layer coating liquid 1.

Formation of Ink-Receiving Layer

The outermost surface layer coating liquid 1, the second ink-receiving layer coating liquid 11, and the first ink-receiving layer coating liquid 1 were applied to each surface of the support. The application was performed with a multilayer slide hopper coater in such a manner that in a dry state, the first ink-receiving layer had a thickness of 25.0 μm, the second ink-receiving layer had a thickness of 10.0 μm, the outermost surface layer had a thickness of 0.12 μm, and the total thickness was 35.12 μm. Subsequently, drying was performed at 60° C. to provide a recording medium 81. The recording medium 81 produced by the foregoing operation included the support, the first ink-receiving layer, the second ink-receiving layer, and the outermost surface layer provided in that order from the support. One hundred freely selected wet-process silica particles on the surfaces of the recording medium were measured. The average secondary particle size was calculated and found to be 3.0 μm.

Production of Recording Medium 82

A recording medium 82 was produced as in recording medium 81, except that the outermost surface layer had a thickness of 0.2 μm. One hundred freely selected wet-process silica particles on the surfaces of the recording medium were measured. The average secondary particle size was calculated and found to be 3.0 μm.

Production of Recording Medium 83

A recording medium 83 was produced as in recording medium 81, except that the outermost surface layer had a thickness of 1.5 μm. One hundred freely selected wet-process silica particles on the surfaces of the recording medium were measured. The average secondary particle size was calculated and found to be 3.0 μm.

Production of Recording Medium 84

A recording medium 84 was produced as in recording medium 81, except that the outermost surface layer had a thickness of 2.0 μm. One hundred freely selected wet-process silica particles on the surfaces of the recording medium were measured. The average secondary particle size was calculated and found to be 3.0 μm.

Production of Recording Medium 85

A recording medium 85 was produced as in recording medium 81, except that the outermost surface layer had a thickness of 5.0 μm. One hundred freely selected wet-process silica particles on the surfaces of the recording medium were measured. The average secondary particle size was calculated and found to be 3.0 μm.

Tables 1 to 3 illustrate compositions of the recording media 1 to 85. In Tables 1 to 3, the term "entire layer" indicates all of the ink-receiving layers including the first ink-receiving layer and the second ink-receiving layer (in the case where the outermost surface layer is provided separately from the second ink-receiving layer, the term "entire layer" includes the outermost surface layer).

TABLE 1

| | | Second ink-receiving layer | | | | First ink-receiving layer | | | Entire layer | |
|---|---|---|---|---|---|---|---|---|---|---|
| | Recording medium | Content of polyvinyl alcohol with respect to inorganic pigment (% by mass) | Content of boric acid with respect to polyvinyl alcohol (% by mass) | Particles | Thickness (μm) | Content of polyvinyl alcohol with respect to inorganic pigment (% by mass) | Content of boric acid with respect to polyvinyl alcohol (% by mass) | Thickness (μm) | Thickness (μm) | Thickness ratio of second ink-receiving layer to first ink-receiving layer |
| Ex. 1 | 1 | 7.0% | 16.4% | FINESIL | 10.0 | 13.0% | 5.8% | 25.0 | 35.0 | 0.40 |
| Ex. 2 | 2 | 7.0% | 16.4% | X-37B | 10.0 | 30.0% | 5.8% | 25.0 | 35.0 | 0.40 |
| Ex. 3 | 3 | 7.0% | 16.4% | 2.0% | 10.0 | 25.0% | 5.8% | 25.0 | 35.0 | 0.40 |
| Ex. 4 | 4 | 7.0% | 16.4% | | 10.0 | 18.0% | 5.8% | 25.0 | 35.0 | 0.40 |
| Ex. 5 | 5 | 7.0% | 16.4% | | 10.0 | 13.0% | 5.8% | 25.0 | 35.0 | 0.40 |
| Ex. 6 | 6 | 7.0% | 16.4% | | 10.0 | 13.0% | 5.8% | 25.0 | 35.0 | 0.40 |
| Ex. 7 | 7 | 7.0% | 16.4% | | 5.0 | 13.0% | 5.8% | 13.0 | 18.0 | 0.38 |
| Ex. 8 | 8 | 7.0% | 16.4% | | 6.0 | 13.0% | 5.8% | 14.0 | 20.0 | 0.43 |
| Ex. 9 | 9 | 7.0% | 16.4% | | 12.0 | 13.0% | 5.8% | 28.0 | 40.0 | 0.43 |
| Ex. 10 | 10 | 7.0% | 16.4% | | 13.0 | 13.0% | 5.8% | 30.0 | 43.0 | 0.43 |
| Ex. 11 | 11 | 7.0% | 16.4% | | 2.5 | 13.0% | 5.8% | 32.5 | 35.0 | 0.08 |
| Ex. 12 | 12 | 7.0% | 16.4% | | 5.0 | 13.0% | 5.8% | 30.0 | 35.0 | 0.17 |
| Ex. 13 | 13 | 7.0% | 16.4% | | 17.5 | 13.0% | 5.8% | 17.5 | 35.0 | 1.00 |
| Ex. 14 | 14 | 7.0% | 16.4% | | 20.0 | 13.0% | 5.8% | 15.0 | 35.0 | 1.33 |
| Ex. 15 | 15 | 7.0% | 10.0% | | 10.0 | 13.0% | 5.8% | 25.0 | 35.0 | 0.40 |
| Ex. 16 | 16 | 7.0% | 30.0% | | 10.0 | 13.0% | 5.8% | 25.0 | 35.0 | 0.40 |
| Ex. 17 | 17 | 4.0% | 28.8% | | 10.0 | 13.0% | 5.8% | 25.0 | 35.0 | 0.40 |
| Ex. 18 | 18 | 5.0% | 23.0% | | 10.0 | 13.0% | 5.8% | 25.0 | 35.0 | 0.40 |
| Ex. 19 | 19 | 10.0% | 11.5% | | 10.0 | 13.0% | 5.8% | 25.0 | 35.0 | 0.40 |
| Ex. 20 | 20 | 11.0% | 10.5% | | 10.0 | 13.0% | 5.8% | 25.0 | 35.0 | 0.40 |
| Ex. 21 | 21 | 7.0% | 16.4% | | 10.0 | 13.0% | 2.3% | 25.0 | 35.0 | 0.40 |
| Ex. 22 | 22 | 7.0% | 16.4% | | 10.0 | 13.0% | 6.9% | 25.0 | 35.0 | 0.40 |
| Ex. 23 | 23 | 7.0% | 16.4% | | 10.0 | 30.0% | 2.3% | 25.0 | 35.0 | 0.40 |
| Ex. 24 | 24 | 7.0% | 16.4% | | 10.0 | 30.0% | 7.0% | 25.0 | 35.0 | 0.40 |
| Ex. 25 | 25 | 7.0% | 16.4% | | 10.0 | 25.0% | 2.4% | 25.0 | 35.0 | 0.40 |
| Ex. 26 | 26 | 7.0% | 16.4% | | 10.0 | 25.0% | 6.8% | 25.0 | 35.0 | 0.40 |
| Ex. 27 | 27 | 7.0% | 16.4% | | 10.0 | 18.0% | 2.2% | 25.0 | 35.0 | 0.40 |
| Ex. 28 | 28 | 7.0% | 16.4% | | 10.0 | 18.0% | 6.7% | 25.0 | 35.0 | 0.40 |
| Ex. 29 | 29 | 7.0% | 16.4% | | 10.0 | 10.0% | 5.8% | 25.0 | 35.0 | 0.40 |

TABLE 1-continued

| | | Second ink-receiving layer | | | | First ink-receiving layer | | | Entire layer | |
|---|---|---|---|---|---|---|---|---|---|---|
| | Recording medium | Content of polyvinyl alcohol with respect to inorganic pigment (% by mass) | Content of boric acid with respect to polyvinyl alcohol (% by mass) | Particles | Thickness (μm) | Content of polyvinyl alcohol with respect to inorganic pigment (% by mass) | Content of boric acid with respect to polyvinyl alcohol (% by mass) | Thickness (μm) | Thickness (μm) | Thickness ratio of second ink-receiving layer to first ink-receiving layer |
| Ex. 30 | 30 | 7.0% | 16.4% | | 10.0 | 11.0% | 5.8% | 25.0 | 35.0 | 0.40 |
| Ex. 31 | 31 | 7.0% | 16.4% | | 10.0 | 40.0% | 5.8% | 25.0 | 35.0 | 0.40 |
| Ex. 32 | 32 | 7.0% | 16.4% | | 10.0 | 42.0% | 5.8% | 25.0 | 35.0 | 0.40 |
| Ex. 33 | 33 | 7.0% | 16.4% | | 10.0 | 10.0% | 5.8% | 25.0 | 35.0 | 0.40 |
| Ex. 34 | 34 | 7.0% | 16.4% | | 10.0 | 11.0% | 5.8% | 25.0 | 35.0 | 0.40 |
| Ex. 35 | 35 | 7.0% | 16.4% | | 10.0 | 40.0% | 5.8% | 25.0 | 35.0 | 0.40 |
| Ex. 36 | 36 | 7.0% | 16.4% | | 10.0 | 42.0% | 5.8% | 25.0 | 35.0 | 0.40 |
| Ex. 37 | 37 | 7.0% | 16.4% | | 10.0 | 10.0% | 5.8% | 25.0 | 35.0 | 0.40 |

TABLE 2

| | | Second ink-receiving layer | | | | First ink-receiving layer | | | Entire layer | |
|---|---|---|---|---|---|---|---|---|---|---|
| | Recording medium | Content of polyvinyl alcohol with respect to inorganic pigment (% by mass) | Content of boric acid with respect to polyvinyl alcohol (% by mass) | Particles | Thickness (μm) | Content of polyvinyl alcohol with respect to inorganic pigment (% by mass) | Content of boric acid with respect to polyvinyl alcohol (% by mass) | Thickness (μm) | Thickness (μm) | Thickness ratio of second ink-receiving layer to first ink-receiving layer |
| Ex. 38 | 38 | 7.0% | 16.4% | FINESIL | 10.0 | 11.0% | 5.8% | 25.0 | 35.0 | 0.40 |
| Ex. 39 | 39 | 7.0% | 16.4% | X-37B | 10.0 | 40.0% | 5.8% | 25.0 | 35.0 | 0.40 |
| Ex. 40 | 40 | 7.0% | 16.4% | 2% | 10.0 | 42.0% | 5.8% | 25.0 | 35.0 | 0.40 |
| Ex. 41 | 41 | 7.0% | 16.4% | | 10.0 | 10.0% | 5.8% | 25.0 | 35.0 | 0.40 |
| Ex. 42 | 42 | 7.0% | 16.4% | | 10.0 | 11.0% | 5.8% | 25.0 | 35.0 | 0.40 |
| Ex. 43 | 43 | 7.0% | 16.4% | | 10.0 | 40.0% | 5.8% | 25.0 | 35.0 | 0.40 |
| Ex. 44 | 44 | 7.0% | 16.4% | | 10.0 | 42.0% | 5.8% | 25.0 | 35.0 | 0.40 |
| Ex. 45 | 45 | 7.0% | 16.4% | | 10.0 | 13.0% | 5.8% | 25.0 | 35.0 | 0.40 |
| Ex. 46 | 46 | 7.0% | 16.4% | | 10.0 | 13.0% | 5.8% | 25.0 | 35.0 | 0.40 |
| Ex. 47 | 47 | 7.0% | 16.4% | | 10.0 | 13.0% | 5.8% | 25.0 | 35.0 | 0.40 |
| Ex. 48 | 48 | 7.0% | 16.4% | FINESIL X-37B 0.5% | 10.0 | 13.0% | 5.8% | 25.0 | 35.0 | 0.40 |
| Ex. 49 | 49 | 7.0% | 16.4% | FINESIL X-37B 5% | 10.0 | 13.0% | 5.8% | 25.0 | 35.0 | 0.40 |
| Ex. 50 | 50 | 7.0% | 16.4% | MBX-8 5% | 10.0 | 13.0% | 5.8% | 25.0 | 35.0 | 0.40 |
| Ex. 51 | 51 | 7.0% | 16.4% | BY-001 20 μm 2% | 10.0 | 13.0% | 5.8% | 25.0 | 35.0 | 0.40 |
| Ex. 52 | 52 | 7.0% | 16.4% | MIZUKASIL P707A 1 μm 2.0% | 10.0 | 13.0% | 5.8% | 25.0 | 35.0 | 0.40 |
| Comp. Ex 1 | 53 | 7.0% | 16.4% | FINESIL X-37B 2.0% | 10.0 | 0.0% | 0.0% | 25.0 | 35.0 | 0.40 |
| Comp. Ex 2 | 54 | — | — | — | 0.0 | 13.0% | 5.8% | 35.0 | 35.0 | 0.00 |
| Comp. Ex 3 | 55 | — | — | — | 0.0 | 30.0% | 5.8% | 35.0 | 35.0 | 0.00 |
| Comp. Ex 4 | 56 | — | — | — | 0.0 | 25.0% | 5.8% | 35.0 | 35.0 | 0.00 |
| Comp. Ex 5 | 57 | — | — | — | 0.0 | 25.0% | 5.8% | 35.0 | 35.0 | 0.00 |
| Comp. Ex 6 | 58 | 13.0% | 5.8% | FINESIL | 10.0 | 7.0% | 16.4% | 25.0 | 35.0 | 0.40 |
| Comp. Ex 7 | 59 | 7.0% | 0.0% | X-37B | 10.0 | 13.0% | 0.0% | 25.0 | 35.0 | 0.40 |
| Comp. Ex 8 | 60 | 7.0% | 16.4% | 2.0% | 10.0 | 13.0% | 0.0% | 25.0 | 35.0 | 0.40 |
| Comp. Ex 9 | 61 | 7.0% | 0.0% | | 10.0 | 13.0% | 5.8% | 25.0 | 35.0 | 0.40 |
| Comp. Ex 10 | 62 | 7.0% | 35.7% | | 10.0 | 13.0% | 5.8% | 25.0 | 35.0 | 0.40 |
| Comp. Ex 11 | 63 | 7.0% | 9.3% | | 10.0 | 13.0% | 5.8% | 25.0 | 35.0 | 0.40 |
| Comp. Ex 12 | 64 | 7.0% | 16.4% | | 10.0 | 13.0% | 1.5% | 25.0 | 35.0 | 0.40 |
| Comp. Ex 13 | 65 | 7.0% | 16.4% | | 10.0 | 13.0% | 7.7% | 25.0 | 35.0 | 0.40 |
| Comp. Ex 14 | 66 | 7.0% | 16.4% | | 10.0 | 30.0% | 1.7% | 25.0 | 35.0 | 0.40 |
| Comp. Ex 15 | 67 | 7.0% | 16.4% | | 10.0 | 30.0% | 7.7% | 25.0 | 35.0 | 0.40 |
| Comp. Ex 16 | 68 | 7.0% | 16.4% | | 10.0 | 25.0% | 1.6% | 25.0 | 35.0 | 0.40 |
| Comp. Ex 17 | 69 | 7.0% | 16.4% | | 10.0 | 25.0% | 7.6% | 25.0 | 35.0 | 0.40 |
| Comp. Ex 18 | 70 | 7.0% | 16.4% | | 10.0 | 18.0% | 1.7% | 25.0 | 35.0 | 0.40 |

TABLE 2-continued

| | | Second ink-receiving layer | | | | First ink-receiving layer | | | Entire layer | |
|---|---|---|---|---|---|---|---|---|---|---|
| | Recording medium | Content of polyvinyl alcohol with respect to inorganic pigment (% by mass) | Content of boric acid with respect to polyvinyl alcohol (% by mass) | Particles | Thickness (μm) | Content of polyvinyl alcohol with respect to inorganic pigment (% by mass) | Content of boric acid with respect to polyvinyl alcohol (% by mass) | Thickness (μm) | Thickness (μm) | Thickness ratio of second ink-receiving layer to first ink-receiving layer |
| Comp. Ex 19 | 71 | 7.0% | 16.4% | | 10.0 | 18.0% | 7.8% | 25.0 | 35.0 | 0.40 |
| Comp. Ex 20 | 72 | 6.8% | 17.7% | | 20.0 | 15.0% | 8.0% | 20.0 | 40.0 | 1.00 |
| Comp. Ex 21 | 73 | 7.0% | 16.4% | FINESIL X-37B 0.3% | 10.0 | 13.0% | 5.8% | 25.0 | 35.0 | 0.40 |
| Comp. Ex 22 | 74 | 7.0% | 16.4% | FINESIL X-37B 7.0% | 10.0 | 13.0% | 5.8% | 25.0 | 35.0 | 0.40 |
| Comp. Ex 23 | 75 | 7.0% | 16.4% | MIZUKASIL P707M 2.0% | 10.0 | 13.0% | 5.8% | 25.0 | 35.0 | 0.40 |

TABLE 3

| | | Outermost surface layer | | | | Second ink-receiving layer | | | | First ink-receiving layer | | | Entire layer | |
|---|---|---|---|---|---|---|---|---|---|---|---|---|---|---|
| | Recording medium | Content of polyvinyl alcohol with respect to inorganic pigment (% by mass) | Content of boric acid with respect to polyvinyl alcohol (% by mass) | Particles | Thickness (μm) | Content of polyvinyl alcohol with respect to inorganic pigment (% by mass) | Content of boric acid with respect to polyvinyl alcohol (% by mass) | Particles | Thickness (μm) | Content of polyvinyl alcohol with respect to inorganic pigment (% by mass) | Content of boric acid with respect to polyvinyl alcohol (% by mass) | Thickness (μm) | Thickness (μm) | Thickness ratio of second ink-receiving layer to first ink-receiving layer |
| Ex. 53 | 81 | 7.0% | 16.4% | FINESIL | 0.12 | 7.0% | 16.4% | 0.0% | 10.0 | 13.0% | 5.8% | 25.0 | 35.12 | 0.40 |
| Ex. 54 | 82 | 7.0% | 16.4% | X-37B | 0.2 | 7.0% | 16.4% | 0.0% | 10.0 | 13.0% | 5.8% | 25.0 | 35.2 | 0.40 |
| Ex. 55 | 83 | 7.0% | 16.4% | 2.0% | 1.5 | 7.0% | 16.4% | 0.0% | 10.0 | 13.0% | 5.8% | 25.0 | 36.5 | 0.40 |
| Ex. 56 | 84 | 7.0% | 16.4% | | 2.0 | 7.0% | 16.4% | 0.0% | 10.0 | 13.0% | 5.8% | 25.0 | 37.0 | 0.40 |
| Ex. 57 | 85 | 7.0% | 16.4% | | 5.0 | 7.0% | 16.4% | 0.0% | 10.0 | 13.0% | 5.8% | 25.0 | 40.0 | 0.40 |

Evaluation

Cracking After Coating

Surfaces of the ink-receiving layers of the resulting recording media were visually observed. The cracking of the recording media after coating were evaluated on the basis of criteria described below. The evaluation results of each recording medium were described in Tables 4 to 6.

5: No crack is observed.

4: Tiny cracks invisible to the naked eye are observed.

3: Cracks visible to the naked eye are observed in some areas.

2: Many cracks visible to the naked eye are observed in the entire surface.

1: Numerous large cracks are observed, and the ink-receiving layers are partially detached from the support.

Resistance to Cracking by Folding

Each of the resulting recording media was formed into an A4-size sheet. A solid black image was formed on the entire recording surface with an inkjet printer (trade name: MP990, manufactured by CANON KABUSHIKI KAISHA). The printed recording medium was folded in the middle in such a manner that the printed surface was inwardly folded. A load of 500 kg was applied to the recording medium with a press for 5 minutes to make a crease. The opening and closing operation of the creased recording medium was performed 20 times. The creased portion was visually checked and evaluated on the basis of criteria described below. The evaluation results were described in Tables 4 to 6.

5: No white streak is seen.

4: A white streak is slightly seen.

3: A white streak is somewhat seen.

2: A white streak is clearly seen.

1: A wide white streak is clearly seen.

Ink Absorbency

A solid green image was formed on the recording surfaces of each of the resulting recording media with an inkjet printer (trade name: MP990, manufactured by CANON KABUSHIKI KAISHA, print mode: Canon Photo Paper Gloss gold, no color correction). The printed portion was visually observed and evaluated on the basis of criteria described below. The evaluation results were described in Tables 4 to 6.

5: The solid image has substantially no uneven portion.

4: The solid image has only a few uneven portions.

3: The solid image has few uneven portions.

2: The solid image has many uneven portions.

1: Ink overflows on the solid image.

Image Density

A solid black image was formed on the recording surfaces of each of the resulting recording media with an inkjet printer (trade name: MP990, manufactured by CANON KABUSHIKI KAISHA, print mode: Canon Photo Paper Gloss gold, no color correction). The optical density of the solid image was measured with an optical reflection densitometer (trade name: 530 spectrodensitometer, manufactured by X-Rite) and evaluated on the basis of criteria described below. The evaluation results were described in Tables 4 to 6.

5: 2.20 or more
4: 2.15 or more and less than 2.20
3: 2.10 or more and less than 2.15
2: 2.00 or more and less than 2.10
1: less than 2.00

Ease of Turning by Hand

Twenty sheets of the recording medium 1 were produced. Twenty sheets, each having a size of 10 cm×10 cm, of the recording medium 1 were stacked and bound on one side. The ease of turning the recording media was evaluated by turning the recording media one by one from an end face on the unbound side. The same operation was also performed for other recording media. The ease of turning was evaluated on the basis of criteria described below. The evaluation results were described in Tables 4 to 6.

5: The sheets of the recording medium have very high sliding properties and are significantly easily turned.
4: The sheets of the recording medium have high sliding properties and are markedly easily turned.
3: The sheets of the recording medium are easily turned.
2: The sheets of the recording medium have low sliding properties and are liable to stick together, so it is difficult to turn the sheets.
1: The sheets of the recording medium have poor sliding properties and are liable to stick together strongly, so it is very difficult to turn the sheets.

Gloss at 20°

The gloss of each record of the resulting recording media at 20° was measured with a measuring apparatus (Model: VG 2000, manufactured by Nippon Denshoku Industries Co., Ltd). The resulting gloss was evaluated on the basis of criteria described below. The evaluation results were described in Tables 4 to 6.

5: The gloss at 20° is 30 or more.
4: The gloss at 20° is 25 or more and less than 30.
3: The gloss at 20° is 20 or more and less than 25.
2: The gloss at 20° is 15 or more and less than 20.
1: The gloss at 20° is less than 15.

TABLE 4

| | | Evaluation result | | | | | |
|---|---|---|---|---|---|---|---|
| | Recording medium | Cracking of coated surface | Resistance to cracking by folding | Ink absorbency | Optical density | Ease of turning by hand | Gloss at 20° |
| Ex. 1 | 1 | 5 | 5 | 5 | 5 | 4 | 3 |
| Ex. 2 | 2 | 5 | 4 | 5 | 4 | 4 | 3 |
| Ex. 3 | 3 | 5 | 4 | 5 | 4 | 4 | 3 |
| Ex. 4 | 4 | 5 | 4 | 5 | 4 | 4 | 3 |
| Ex. 5 | 5 | 5 | 4 | 5 | 4 | 4 | 3 |
| Ex. 6 | 6 | 5 | 4 | 5 | 4 | 4 | 3 |
| Ex. 7 | 7 | 5 | 5 | 3 | 3 | 3 | 4 |
| Ex. 8 | 8 | 5 | 5 | 4 | 4 | 3 | 4 |
| Ex. 9 | 9 | 4 | 4 | 5 | 5 | 4 | 3 |
| Ex. 10 | 10 | 3 | 3 | 5 | 5 | 4 | 3 |
| Ex. 11 | 11 | 5 | 5 | 3 | 4 | 3 | 4 |
| Ex. 12 | 12 | 5 | 5 | 4 | 4 | 3 | 4 |
| Ex. 13 | 13 | 5 | 4 | 5 | 5 | 5 | 3 |
| Ex. 14 | 14 | 4 | 3 | 5 | 5 | 5 | 3 |
| Ex. 15 | 15 | 4 | 5 | 3 | 5 | 4 | 4 |
| Ex. 16 | 16 | 5 | 3 | 5 | 5 | 4 | 4 |
| Ex. 17 | 17 | 3 | 3 | 5 | 5 | 4 | 4 |
| Ex. 18 | 18 | 4 | 4 | 5 | 5 | 4 | 4 |
| Ex. 19 | 19 | 5 | 5 | 4 | 5 | 4 | 4 |
| Ex. 20 | 20 | 5 | 5 | 3 | 4 | 4 | 4 |
| Ex. 21 | 21 | 3 | 5 | 4 | 5 | 4 | 4 |
| Ex. 22 | 22 | 5 | 3 | 5 | 5 | 4 | 4 |
| Ex. 23 | 23 | 3 | 4 | 3 | 4 | 4 | 4 |
| Ex. 24 | 24 | 5 | 3 | 4 | 4 | 4 | 4 |
| Ex. 25 | 25 | 3 | 4 | 3 | 4 | 4 | 4 |
| Ex. 26 | 26 | 5 | 3 | 4 | 4 | 4 | 4 |
| Ex. 27 | 27 | 3 | 4 | 4 | 4 | 4 | 4 |
| Ex. 28 | 28 | 5 | 3 | 5 | 4 | 4 | 4 |
| Ex. 29 | 29 | 3 | 3 | 5 | 5 | 4 | 4 |
| Ex. 30 | 30 | 4 | 4 | 5 | 5 | 4 | 4 |
| Ex. 31 | 31 | 5 | 5 | 4 | 5 | 4 | 4 |
| Ex. 32 | 32 | 5 | 5 | 3 | 4 | 4 | 4 |
| Ex. 33 | 33 | 3 | 3 | 4 | 4 | 4 | 4 |
| Ex. 34 | 34 | 4 | 4 | 5 | 4 | 4 | 4 |
| Ex. 35 | 35 | 5 | 5 | 4 | 4 | 4 | 4 |
| Ex. 36 | 36 | 5 | 5 | 3 | 4 | 4 | 4 |
| Ex. 37 | 37 | 3 | 3 | 5 | 4 | 4 | 4 |

TABLE 5

| | Recording medium | Evaluation result | | | | | |
|---|---|---|---|---|---|---|---|
| | | Cracking of coated surface | Resistance to cracking by folding | Ink absorbency | Optical density | Ease of turning by hand | Gloss at 20 ° |
| Ex. 38 | 38 | 4 | 4 | 5 | 4 | 4 | 4 |
| Ex. 39 | 39 | 5 | 5 | 4 | 4 | 4 | 4 |
| Ex. 40 | 40 | 5 | 5 | 3 | 3 | 4 | 4 |
| Ex. 41 | 41 | 3 | 3 | 5 | 4 | 4 | 4 |
| Ex. 42 | 42 | 4 | 4 | 5 | 4 | 4 | 4 |
| Ex. 43 | 43 | 5 | 5 | 4 | 4 | 4 | 4 |
| Ex. 44 | 44 | 5 | 5 | 3 | 3 | 4 | 4 |
| Ex. 45 | 45 | 5 | 5 | 3 | 4 | 4 | 4 |
| Ex. 46 | 46 | 3 | 3 | 5 | 5 | 4 | 4 |
| Ex. 47 | 47 | 3 | 3 | 5 | 4 | 4 | 4 |
| Ex. 48 | 48 | 5 | 5 | 5 | 5 | 3 | 4 |
| Ex. 49 | 49 | 5 | 5 | 5 | 5 | 5 | 3 |
| Ex. 50 | 50 | 5 | 5 | 5 | 5 | 5 | 3 |
| Ex. 51 | 51 | 5 | 5 | 5 | 5 | 5 | 3 |
| Ex. 52 | 52 | 5 | 5 | 5 | 5 | 5 | 3 |
| Comp. Ex 1 | 53 | 1 | 1 | 5 | 5 | 4 | 4 |
| Comp. Ex 2 | 54 | 5 | 5 | 2 | 2 | 1 | 5 |
| Comp. Ex 3 | 55 | 5 | 4 | 1 | 2 | 1 | 2 |
| Comp. Ex 4 | 56 | 5 | 4 | 1 | 1 | 1 | 3 |
| Comp. Ex 5 | 57 | 5 | 4 | 2 | 2 | 1 | 4 |
| Comp. Ex 6 | 58 | 5 | 1 | 1 | 2 | 4 | 4 |
| Comp. Ex 7 | 59 | 1 | 2 | 1 | 3 | 4 | 4 |
| Comp. Ex 8 | 60 | 1 | 2 | 2 | 3 | 4 | 4 |
| Comp. Ex 9 | 61 | 2 | 2 | 2 | 3 | 4 | 4 |
| Comp. Ex 10 | 62 | 5 | 2 | 5 | 5 | 4 | 4 |
| Comp. Ex 11 | 63 | 3 | 5 | 2 | 4 | 4 | 4 |
| Comp. Ex 12 | 64 | 2 | 2 | 2 | 4 | 4 | 4 |
| Comp. Ex 13 | 65 | 5 | 2 | 5 | 5 | 4 | 4 |
| Comp. Ex 14 | 66 | 1 | 2 | 3 | 3 | 4 | 4 |
| Comp. Ex 15 | 67 | 5 | 1 | 5 | 4 | 4 | 4 |
| Comp. Ex 16 | 68 | 2 | 2 | 3 | 3 | 4 | 4 |
| Comp. Ex 17 | 69 | 5 | 1 | 5 | 4 | 4 | 4 |
| Comp. Ex 18 | 70 | 2 | 2 | 3 | 4 | 4 | 4 |
| Comp. Ex 19 | 71 | 5 | 1 | 5 | 4 | 4 | 4 |
| Comp. Ex 20 | 72 | 5 | 2 | 5 | 5 | 5 | 3 |
| Comp. Ex 21 | 73 | 3 | 4 | 5 | 5 | 1 | 4 |
| Comp. Ex 22 | 74 | 3 | 4 | 5 | 5 | 5 | 1 |
| Comp. Ex 23 | 75 | 5 | 5 | 5 | 5 | 5 | 1 |

TABLE 6

| | Recording medium | Evaluation result | | | | | |
|---|---|---|---|---|---|---|---|
| | | Cracking of coated surface | Resistance to cracking by folding | Ink absorbency | Optical density | Ease of turning by hand | Gloss at 20° |
| Ex. 53 | 81 | 5 | 5 | 5 | 5 | 4 | 5 |
| Ex. 54 | 82 | 5 | 5 | 5 | 5 | 5 | 5 |
| Ex. 55 | 83 | 5 | 5 | 5 | 5 | 5 | 5 |
| Ex. 56 | 84 | 5 | 5 | 5 | 5 | 5 | 5 |
| Ex. 57 | 85 | 5 | 5 | 5 | 5 | 5 | 4 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-253959 filed Nov. 21, 2011, which is hereby incorporated by reference herein in its entirety.

What is claimed is:

1. A recording medium comprising, in sequence:

a support;

a first ink-receiving layer; and a second ink-receiving layer which is the outermost surface layer of the recording medium, wherein the first ink-receiving layer contains at least one inorganic pigment selected from the group consisting of an alumina, an alumina hydrate, and a fumed silica, a polyvinyl alcohol, and a boric acid, and the second ink-receiving layer contains at least one inorganic pigment selected from the group consisting of an alumina and an alumina hydrate, a polyvinyl alcohol, and a boric acid, wherein a content of the boric acid in the first ink-receiving layer is 2.0% by mass or more and 7.0% by mass or less with respect to a content of the polyvinyl alcohol in the first ink-receiving layer, and a content of the boric acid in the second ink-receiving layer is 10.0% by mass or more and 30.0% by mass or less with respect to a content of the polyvinyl alcohol in the second ink-receiving layer, wherein the second ink-receiving layer of the recording medium contains particles having an average secondary particle size of 1.0 μm or more and 20.0 μm or less, wherein a content of the particles having an average secondary particle size of 1.0 μm or more and 20.0 μm or less is 0.5% by mass or more and 5.0% by mass or less with respect to a content of the inorganic pigment in the second ink-receiving layer.

2. The recording medium according to claim 1, wherein the support is a water resistant support produced by covering a base paper with a resin.

3. The recording medium according to claim 1, wherein the particles having an average secondary particle size of 1.0 μm or more and 20.0 μm or less are composed of a wet-process silica.

4. The recording medium according to claim 1, wherein the inorganic pigment at least one selected from the group consisting of the alumina and the alumina hydrate in the second ink-receiving layer has an average secondary particle size of 50 nm or more and 300 nm or less.

5. The recording medium according to claim 1, wherein a content of the polyvinyl alcohol is 11.0% by mass or more and 40.0% by mass or less with respect to a content of the inorganic pigment in the first ink-receiving layer.

6. A recording medium comprising, in sequence:

a support;

a first ink-receiving layer;

a second ink-receiving layer; and an outermost surface layer, wherein the first ink-receiving layer contains at least one inorganic pigment selected from the group consisting of an alumina, an alumina hydrate, and a fumed silica, a polyvinyl alcohol, and a boric acid, and the second ink-receiving layer contains at least one inorganic pigment selected from the group consisting of an alumina and an alumina hydrate, a polyvinyl alcohol, and a boric acid, the outermost surface layer contains at least one inorganic pigment selected from the group consisting of an alumina and an alumina hydrate, particles having an average secondary particle size of 1.0 μm or more and 20.0 μm or less, a polyvinyl alcohol, and a boric acid, wherein a content of the boric acid in the first ink-receiving layer is 2.0% by mass or more and 7.0% by mass or less with respect to a content of the polyvinyl alcohol in the first ink-receiving layer, and a content of the boric acid in the second ink-receiving layer is 10.0% by mass or more and 30.0% by mass or less with respect to a content of the polyvinyl alcohol in the second ink-receiving layer, wherein a content of the particles having an average secondary particle size of 1.0 μm or more and 20.0 μm or less is 0.5% by mass or more and 5.0% by mass or less with respect to a content of the inorganic pigment in the outermost surface layer.

7. The recording medium according to claim 6, wherein the inorganic pigment at least one selected from the group consisting of the alumina and the alumina hydrate in the outermost surface layer has an average secondary particle size of 50 nm or more and 300 nm or less.

8. The recording medium according to claim 6, wherein a content of the polyvinyl alcohol is 11.0% by mass or more and 40.0% by mass or less with respect to a content of the inorganic pigment in the first ink-receiving layer.

* * * * *